US010774690B2

(12) United States Patent
Shaffer et al.

(10) Patent No.: US 10,774,690 B2
(45) **Date of Patent: *Sep. 15, 2020**

(54) COMPACT ENERGY CYCLE CONSTRUCTION UTILIZING SOME COMBINATION OF A SCROLL TYPE EXPANDER, PUMP, AND COMPRESSOR FOR OPERATING ACCORDING TO A RANKINE, AN ORGANIC RANKINE, HEAT PUMP, OR COMBINED ORGANIC RANKINE AND HEAT PUMP CYCLE

(71) Applicant: Air Squared, Inc., Broomfield, CO (US)

(72) Inventors: Robert W. Shaffer, Broomfield, CO (US); Bryce R. Shaffer, Broomfield, CO (US)

(73) Assignee: Air Squared, Inc., Broomfield, CO (US)

( * ) Notice: Subject to any disclaimer, the term of this patent is extended or adjusted under 35 U.S.C. 154(b) by 220 days.

This patent is subject to a terminal disclaimer.

(21) Appl. No.: 15/932,150

(22) Filed: Feb. 12, 2018

(65) Prior Publication Data

US 2018/0216498 A1 Aug. 2, 2018

Related U.S. Application Data

(63) Continuation-in-part of application No. 15/731,929, filed on Aug. 24, 2017, now Pat. No. 10,519,815, (Continued)

(51) Int. Cl.
*F01K 13/00* (2006.01)
*F04C 29/04* (2006.01)
(Continued)

(52) U.S. Cl.
CPC ..... *F01K 13/02* (2013.01); *F01C 1/0215* (2013.01); *F01C 1/0269* (2013.01); (Continued)

(58) Field of Classification Search
CPC ..... F01K 11/00; F01K 11/02; F01K 11/04; F25B 3/00
See application file for complete search history.

(56) References Cited

U.S. PATENT DOCUMENTS 801,182 A 10/1905 Creux
2,079,118 A 5/1937 Hingst
(Continued)

FOREIGN PATENT DOCUMENTS

CN 105402134 3/2016
DE 460936 6/1928
(Continued)

OTHER PUBLICATIONS

"Heat Pump and Refrigeration Cycle," Wikipedia, last updated May 10, 2013, 4 pages [retrieved online from: en.wikipedia.org/wiki/Heat_pump_and_refrigeration_cycle].
(Continued)

*Primary Examiner* — Laert Dounis
(74) *Attorney, Agent, or Firm* — Sheridan Ross P.C.

(57) ABSTRACT

A compact energy cycle construction that utilizes a working fluid in its operation is disclosed having a compact housing of a generally cylindrical form, an orbiting scroll type expander, a central shaft which is driven by the expander, a generator having a rotor and a stator with the central shaft being mounted to the rotor for rotating the rotor relative to the stator, a pump mounted to the central shaft, an evaporator positioned between the expander and the generator and surrounding the central shaft, and the orbiting scroll type expander, the central shaft, the generator, the pump, and the
(Continued)

evaporator being housed within the compact housing to form an integrated system operable in accordance with an energy cycle.

18 Claims, 14 Drawing Sheets

Related U.S. Application Data which is a continuation of application No. 14/756,594, filed on Sep. 22, 2015, now Pat. No. 9,784,139, which is a continuation of application No. 13/986,349, filed on Apr. 23, 2013, now abandoned, and a continuation-in-part of application No. 13/507,779, filed on Jul. 30, 2012, now Pat. No. 9,074,598.

(60) Provisional application No. 61/687,464, filed on Apr. 25, 2012, provisional application No. 61/574,771, filed on Aug. 9, 2011.

(51) Int. Cl.

| | |
|---|---|
| ***F01K 11/04*** | (2006.01) |
| ***F01K 9/02*** | (2006.01) |
| ***F01K 11/00*** | (2006.01) |
| ***F25B 11/04*** | (2006.01) |
| ***F01K 13/02*** | (2006.01) |
| ***F04C 29/02*** | (2006.01) |
| ***F04C 23/00*** | (2006.01) |
| ***F01C 11/00*** | (2006.01) |
| ***F01C 1/02*** | (2006.01) |
| ***F25B 1/04*** | (2006.01) |
| ***F04C 18/02*** | (2006.01) |
| ***F25B 30/02*** | (2006.01) |

(52) U.S. Cl.

CPC ..... *F01C 11/006* (2013.01); *F01K 9/02* (2013.01); *F01K 11/00* (2013.01); *F01K 11/04* (2013.01); *F01K 13/00* (2013.01); *F04C 18/0215* (2013.01); *F04C 18/0269* (2013.01); *F04C 23/008* (2013.01); *F04C 29/023* (2013.01); *F04C 29/042* (2013.01); *F25B 1/04* (2013.01); *F25B 30/02* (2013.01); *F25B 11/04* (2013.01)

(56) References Cited

U.S. PATENT DOCUMENTS

| | | | |
|---|---|---|---|
| 2,330,121 | A | 9/1943 | Heintz |
| 2,968,157 | A | 1/1961 | Cronan |
| 3,011,694 | A | 12/1961 | Mulhouse et al. |
| 3,470,704 | A | 10/1969 | Kantor |
| 3,613,368 | A | 10/1971 | Doerner |
| 3,802,809 | A | 4/1974 | Vulliez |
| 3,842,596 | A | 10/1974 | Gray |
| 3,986,799 | A | 10/1976 | McCullough |
| 3,986,852 | A | 10/1976 | Doerner et al. |
| 3,994,635 | A | 11/1976 | McCullough |
| 3,994,636 | A | 11/1976 | McCullough et al. |
| 3,999,400 | A | 12/1976 | Gray |
| 4,065,279 | A | 12/1977 | McCullough |
| 4,069,673 | A | 1/1978 | Lapeyre |
| 4,082,484 | A | 4/1978 | McCullough |
| 4,157,234 | A | 6/1979 | Weaver et al. |
| 4,192,152 | A | 3/1980 | Armstrong et al. |
| 4,300,875 | A | 11/1981 | Fischer et al. |
| 4,340,339 | A | 7/1982 | Hiraga et al. |
| 4,382,754 | A | 5/1983 | Shaffer et al. |
| 4,395,885 | A | 8/1983 | Cozby |
| 4,411,605 | A | 10/1983 | Sauls |
| 4,415,317 | A | 11/1983 | Buttersworth |
| 4,416,597 | A | 11/1983 | Eber et al. |
| 4,436,495 | A | 3/1984 | McCullough |
| 4,457,674 | A | 7/1984 | Kawano et al. |
| 4,462,771 | A | 7/1984 | Teegarden |
| 4,472,120 | A | 9/1984 | McCullough |
| 4,477,238 | A | 10/1984 | Terauchi |
| 4,511,091 | A | 4/1985 | Vasco |
| 4,673,339 | A | 6/1987 | Hayano et al. |
| 4,718,836 | A | 1/1988 | Pottier et al. |
| 4,722,676 | A | 2/1988 | Sugimoto |
| 4,726,100 | A | 2/1988 | Etemad et al. |
| 4,730,375 | A | 3/1988 | Nakamura et al. |
| 4,732,550 | A | 3/1988 | Suzuki et al. |
| 4,802,831 | A | 2/1989 | Suefuji et al. |
| 4,867,657 | A | 9/1989 | Kotlarek et al. |
| 4,875,839 | A | 10/1989 | Sakata et al. |
| 4,892,469 | A | 1/1990 | McCullough et al. |
| 5,013,226 | A | 5/1991 | Nishida |
| 5,037,280 | A | 8/1991 | Nishida et al. |
| 5,040,956 | A | 8/1991 | Barito et al. |
| 5,044,904 | A | 9/1991 | Richardson, Jr. |
| 5,051,079 | A | 9/1991 | Richardson, Jr. |
| 5,082,430 | A | 1/1992 | Guttinger |
| 5,099,658 | A | 3/1992 | Utter et al. |
| 5,108,274 | A | 4/1992 | Kakuda et al. |
| 5,127,809 | A | 7/1992 | Amata et al. |
| 5,142,885 | A | 9/1992 | Utter et al. |
| 5,160,253 | A | 11/1992 | Okada et al. |
| 5,214,932 | A | 6/1993 | Abdelmalek |
| 5,222,882 | A | 6/1993 | McCullough |
| 5,228,309 | A * | 7/1993 | McCullough ..... A62B 17/005 123/204 |
| 5,232,355 | A | 8/1993 | Fujii et al. |
| 5,242,284 | A | 9/1993 | Mitsunaga et al. |
| 5,258,046 | A | 11/1993 | Haga et al. |
| 5,338,159 | A | 8/1994 | Riffe et al. |
| 5,417,554 | A | 5/1995 | Kietzman et al. |
| 5,449,279 | A | 9/1995 | Hill et al. |
| 5,466,134 | A | 11/1995 | Shaffer et al. |
| 5,496,161 | A | 3/1996 | Machida et al. |
| 5,609,478 | A | 3/1997 | Utter et al. |
| 5,616,015 | A | 4/1997 | Liepert |
| 5,632,612 | A | 5/1997 | Shaffer |
| 5,632,613 | A | 5/1997 | Shin et al. |
| 5,752,816 | A | 5/1998 | Shaffer |
| 5,759,020 | A | 6/1998 | Shaffer |
| 5,803,723 | A | 9/1998 | Suefuji et al. |
| 5,836,752 | A | 11/1998 | Calhoun et al. |
| 5,842,843 | A | 12/1998 | Haga |
| 5,855,473 | A | 1/1999 | Liepert |
| 5,857,844 | A | 1/1999 | Lifson et al. |
| 5,873,711 | A | 2/1999 | Lifson |
| 5,938,419 | A | 8/1999 | Honma et al. |
| 5,951,268 | A | 9/1999 | Pottier et al. |
| 5,961,297 | A | 10/1999 | Haga et al. |
| 5,987,894 | A | 11/1999 | Claudet |
| 6,008,557 | A | 12/1999 | Dornhoefer et al. |
| 6,050,792 | A | 4/2000 | Shaffer |
| 6,068,459 | A | 5/2000 | Clarke et al. |
| 6,074,185 | A | 6/2000 | Protos |
| 6,129,530 | A | 10/2000 | Shaffer |
| 6,179,590 | B1 | 1/2001 | Honma et al. |
| 6,186,755 | B1 | 2/2001 | Haga |
| 6,190,145 | B1 | 2/2001 | Fujioka et al. |
| 6,193,487 | B1 | 2/2001 | Ni |
| 6,283,737 | B1 | 9/2001 | Kazikis et al. |
| 6,379,134 | B2 | 4/2002 | Iizuka |
| 6,434,943 | B1 | 8/2002 | Garris |
| 6,439,864 | B1 | 8/2002 | Shaffer |
| 6,464,467 | B2 | 10/2002 | Sullivan et al. |
| 6,511,308 | B2 | 1/2003 | Shaffer |
| 6,712,589 | B2 | 3/2004 | Mori et al. |
| 6,736,622 | B1 | 5/2004 | Bush et al. |
| 6,905,320 | B2 | 6/2005 | Satoh et al. |
| 6,922,999 | B2 | 8/2005 | Kimura et al. |
| 7,124,585 | B2 | 10/2006 | Kim et al. |
| 7,249,459 | B2 | 7/2007 | Hisanaga et al. |
| 7,306,439 | B2 | 12/2007 | Unami et al. |
| 7,314,358 | B2 | 1/2008 | Tsuchiya |

(56) References Cited

U.S. PATENT DOCUMENTS

| | | | |
|---|---|---|---|
| 7,458,152 | B2 | 12/2008 | Sato |
| 7,458,414 | B2 | 12/2008 | Simon |
| 7,836,696 | B2 | 11/2010 | Uno et al. |
| 7,942,655 | B2 | 5/2011 | Shaffer |
| 7,980,078 | B2 | 7/2011 | McCutchen et al. |
| 8,007,260 | B2 | 8/2011 | Yanagisawa |
| 8,087,260 | B2 | 1/2012 | Ogata et al. |
| 8,186,980 | B2 | 5/2012 | Komai et al. |
| 8,328,544 | B2 | 12/2012 | Iwano et al. |
| 8,484,974 | B1 | 7/2013 | Monson et al. |
| 8,523,544 | B2 | 9/2013 | Shaffer |
| 8,668,479 | B2 | 3/2014 | Shaffer |
| 8,674,525 | B2 | 3/2014 | Van Den Bossche et al. |
| 9,022,758 | B2 | 5/2015 | Roof et al. |
| 9,028,230 | B2 | 5/2015 | Shaffer |
| 9,074,598 | B2 | 7/2015 | Shaffer et al. |
| 9,657,733 | B2 | 5/2017 | Chadwick et al. |
| 9,784,139 | B2 | 10/2017 | Shaffer et al. |
| 9,885,358 | B2 | 2/2018 | Shaffer |
| 1,022,185 | A1 | 3/2019 | Shaffer et al. |
| 2001/0043878 | A1 | 11/2001 | Sullivan et al. |
| 2002/0011332 | A1 | 1/2002 | Oh et al. |
| 2002/0071779 | A1 | 6/2002 | Moroi et al. |
| 2003/0017070 | A1 | 1/2003 | Moroi et al. |
| 2003/0138339 | A1 | 7/2003 | Scancarello |
| 2003/0223898 | A1 | 12/2003 | Fujioka et al. |
| 2004/0020206 | A1 | 2/2004 | Sullivan et al. |
| 2004/0255591 | A1 | 12/2004 | Hisanga et al. |
| 2005/0031469 | A1 | 2/2005 | Yanagisawa et al. |
| 2006/0016184 | A1 | 1/2006 | Simon |
| 2006/0045783 | A1 | 3/2006 | Yanagisawa et al. |
| 2006/0130495 | A1 | 6/2006 | Dieckmann et al. |
| 2007/0108934 | A1 | 5/2007 | Smith et al. |
| 2007/0172373 | A1 | 7/2007 | Ni |
| 2007/0231174 | A1 | 10/2007 | Ishizuki |
| 2008/0159888 | A1 | 7/2008 | Nakayama et al. |
| 2008/0193311 | A1 | 8/2008 | Helies |
| 2009/0148327 | A1 | 6/2009 | Carter et al. |
| 2009/0246055 | A1 | 10/2009 | Stehouwer et al. |
| 2010/0111740 | A1 | 5/2010 | Ni |
| 2010/0254835 | A1 | 10/2010 | Kane et al. |
| 2010/0287954 | A1 | 11/2010 | Harman et al. |
| 2011/0129362 | A1 | 6/2011 | Kameya et al. |
| 2012/0134862 | A1 | 5/2012 | Hockliffe et al. |
| 2013/0207396 | A1* | 8/2013 | Tsuboi ..... H02K 7/1823 290/52 |
| 2013/0232975 | A1 | 9/2013 | Shaffer et al. |
| 2014/0023540 | A1 | 1/2014 | Heidecker et al. |
| 2014/0260364 | A1* | 9/2014 | Litch ..... F25B 39/02 62/82 |
| 2017/0045046 | A1 | 2/2017 | Afshari |
| 2017/0051741 | A1 | 2/2017 | Shaffer et al. |
| 2017/0074265 | A1 | 3/2017 | Asami et al. |
| 2017/0268514 | A1 | 9/2017 | Shaffer |
| 2017/0362962 | A1 | 12/2017 | Shaffer et al. |
| 2018/0163725 | A1 | 6/2018 | Valdez et al. |
| 2018/0163726 | A1 | 6/2018 | Shaffer et al. |
| 2019/0211824 | A1 | 7/2019 | Shaffer et al. |

FOREIGN PATENT DOCUMENTS

| | | |
|---|---|---|
| DE | 19957425 | 8/2000 |
| EP | 0513824 | 11/1992 |
| EP | 0780576 | 6/1997 |
| EP | 3239526 | 11/2017 |
| GB | 0513827 | 10/1939 |
| GB | 2002455 | 2/1979 |
| GB | 1575684 | 9/1980 |
| JP | S56-019369 | 2/1981 |
| JP | S57-171002 | 10/1982 |
| JP | H05-157076 | 6/1993 |
| JP | H07-109981 | 4/1995 |
| JP | H07-324688 | 12/1995 |
| WO | WO 2004/008829 | 1/2004 |
| WO | WO 2009/050126 | 4/2009 |
| WO | WO 2015/164453 | 10/2015 |

OTHER PUBLICATIONS

"Involute," Wikipedia, last modified Jun. 2, 2012, 5 pages [retrieved online from: en.wikipedia.org/wiki/Involute].

"Oldham Coupler," Wikipedia, last modified, Feb. 9, 2010, 2 pages [retrieved online from: en.wikipedia.org/wiki/Oldham_coupler].

"Organic Rankine Cycle," Wikipedia, last modified May 19, 2013, 4 pages [retrieved online from: en.wikipedia.org/wiki/Organic_Rankine_Cycle].

"Rankine Cycle," Wikipedia, last modified Apr. 29, 2013, 4 pages [retrieved online from: en.wikipedia.org/wiki/Rankine_cycle].

"Scroll Compressor," Wikipedia, last modified Apr. 24, 2013, 3 pages [retrieved online from: en.wikipedia.org/wiki/Scroll_compressor].

"Thrust Bearing," Wikipedia, last modified Dec. 19, 2012, 2 pages [retrieved online from: en.wikipedia.org/wiki/Thrust_bearing].

International Search Report and Written Opinion for Interiantional (PCT) Patent Application No. PCT/US2018/064427, dated Feb. 5, 2019 14 pages.

International Search Report for International (PCT) Patent Application No. PCT/US01/43523, dated Jun. 5, 2002 1 page.

International Search Report for International (PCT) Patent Application No. PCT/US01/50377, dated May 13, 2002 1 page.

Partial Search Report for European Patent Application No. 13003663.5, dated May 28, 2014 5 pages.

Extended Search Report for European Patent Application No. 13003663.5, dated Sep. 3, 2014 11 pages.

International Search Report and Written Opinion for International (PCT) Patent Application No. PCT/US14/00076, dated Dec. 17, 2014 6 pages.

International Search Report and Written Opinion for International (PCT) Patent Application No. PCT/US18/00118, dated Sep. 24, 2018 19 pages.

Official Action for U.S. Appl. No. 11/703,585, dated Dec. 18, 2009 7 pages.

Official Action for U.S. Appl. No. 11/703,585, dated Jul. 20, 2010 7 pages.

Notice of Allowance for U.S. Appl. No. 11/703,585, dated Feb. 4, 2011 4 pages.

Official Action for U.S. Appl. No. 12/930,140, dated Jan. 14, 2013 22 pages.

Official Action for U.S. Appl. No. 12/930,140, dated Jun. 13, 2013 21 pages.

Notice of Allowance for U.S. Appl. No. 12/930,140, dated Oct. 24, 2013 12 pages.

Official Action for U.S. Appl. No. 13/066,261, dated Feb. 11, 2013 5 pages Restriction Requirement.

Notice of Allowance for U.S. Appl. No. 13/066,261, dated Apr. 4, 2013 13 pages.

Official Action for U.S. Appl. No. 13/987,486, dated Dec. 16, 2013 5 pages Restriction Requirement.

Official Action for U.S. Appl. No. 13/987,486, dated Apr. 23, 2014 13 pages.

Official Action for U.S. Appl. No. 13/987,486, dated Oct. 20, 2014 11 pages.

Notice of Allowance for U.S. Appl. No. 13/987,486, dated Jan. 5, 2015 5 pages.

Corrected Notice of Allowance for U.S. Appl. No. 13/987,486, dated Feb. 20, 2015 8 pages.

Official Action for U.S. Appl. No. 14/544,874, dated Dec. 23, 2016 5 pages Restriction Requirement.

Official Action for U.S. Appl. No. 14/544,874, dated Jan. 26, 2017 9 pages.

Official Action for U.S. Appl. No. 14/544,874, dated Jul. 21, 2017 6 pages.

Notice of Allowance for U.S. Appl. No. 14/544,874, dated Sep. 28, 2017 5 pages.

(56) References Cited

OTHER PUBLICATIONS

Official Action for U.S. Appl. No. 15/330,223, dated Nov. 15, 2017 6 pages Restriction Requirement.
Official Action for U.S. Appl. No. 15/330,223, dated Feb. 7, 2018 10 pages.
Official Action for U.S. Appl. No. 15/330,223, dated Aug. 7, 2018 10 pages.
Official Action for U.S. Appl. No. 15/330,223, dated Jan. 11, 2019 14 pages.
Official Action for U.S. Appl. No. 14/507,779, dated Apr. 8, 2014 17 pages.
Official Action for U.S. Appl. No. 13/507,779, dated Dec. 1, 2014 17 pages.
Notice of Allowance for U.S. Appl. No. 14/507,779, dated Mar. 6, 2015 8 pages.
Official Action for U.S. Appl. No. 13/986,349, dated Jan. 21, 2015 25 pages.
Official Action for U.S. Appl. No. 13/986,349, dated Aug. 12, 2015 20 pages.
Official Action for U.S. Appl. No. 14/756,594, dated Mar. 29, 2017 13 pages.
Notice of Allowance for U.S. Appl. No. 14/756,594, dated Jun. 5, 2017 8 pages.
Official Action for U.S. Appl. No. 15/731,929, dated Jan. 31, 2019 11 pages.
Official Action for U.S. Appl. No. 14/999,427, dated Oct. 5, 2017 6 pages Restriction Requirement.
Official Action for U.S. Appl. No. 14/999,427, dated Feb. 9, 2018 9 pages.
Notice of Allowance for U.S. Appl. No. 14/999,427, dated Sep. 21, 2018 18 pages.
Official Action for U.S. Appl. No. 15/731,324, dated Feb. 7, 2019 15 pages.
Official Action for U.S. Appl. No. 15/373,979, dated Jan. 29, 2019 12 pages.
"Digital Scroll Compressor Technology," Wikipedia, 2010, 3 pages [retrieved online from: en.wikipedia.org/wiki/Digital_Scroll_Compressor_Technology].
Official Action for U.S. Appl. No. 15/731,929, dated Jun. 4, 2019 10 pages.
Notice of Allowance for U.S. Appl. No. 15/731,929, dated Aug. 14, 2019 9 pages.
Notice of Allowance for U.S. Appl. No. 15/731,324, dated Aug. 2, 2019 11 pages.
Notice of Allowance for U.S. Appl. No. 15/373,979, dated Apr. 26, 2019 9 pages.
U.S. Appl. No. 16/275,943, filed Feb. 14, 2019.
U.S. Appl. No. 16/213,111, filed Dec. 7, 2018.
U.S. Appl. No. 09/161,629, filed Sep. 28, 1998 now U.S. Pat. No. 6,129,530.
U.S. Appl. No. 09/715,726, filed Nov. 20, 2000 now U.S. Pat. No. 6,439,864.
U.S. Appl. No. 09/751,057, filed Jan. 2, 2001 now U.S. Pat. No. 6,511,308.
U.S. Appl. No. 09/228,485, filed Jan. 11, 1999 now U.S. Pat. No. 6,050,792.
U.S. Appl. No. 11/703,585, filed Feb. 6, 2007 now U.S. Pat. No. 7,942,655.
U.S. Appl. No. 12/930,140, filed Dec. 29, 2010 now U.S. Pat. No. 8,668,479.
U.S. Appl. No. 13/066,261, filed Apr. 11, 2011 now U.S. Pat. No. 8,523,544.
U.S. Appl. No. 13/987,486, filed Jul. 30, 2013 now U.S. Pat. No. 9,028,230.
U.S. Appl. No. 14/544,874, filed Feb. 27, 2015 now U.S. Pat. No. 9,885,358.
U.S. Appl. No. 15/330,223, filed Aug. 26, 2016.
U.S. Appl. No. 13/507,779, filed Jul. 30, 2012 now U.S. Pat. No. 9,074,598.
U.S. Appl. No. 13/986,349, filed Apr. 23, 2013.
U.S. Appl. No. 14/756,594, filed Sep. 22, 2015 now U.S. Pat. No. 9,784,139.
U.S. Appl. No. 15/731,929, filed Aug. 24, 2017.
U.S. Appl. No. 14/999,427, filed May 4, 2016 now U.S. Pat. No. 10,221,852.
U.S. Appl. No. 16/291,984, filed Mar. 4, 2019.
U.S. Appl. No. 15/731,324, filed May 25, 2017.
U.S. Appl. No. 15/732,593, filed Nov. 30, 2017.
U.S. Appl. No. 15/373,979, filed Dec. 9, 2016.

* cited by examiner

CONFIGURATION A : SPIRAL PATH

CONFIGURATION B : FINS

COMPACT ENERGY CYCLE CONSTRUCTION UTILIZING SOME COMBINATION OF A SCROLL TYPE EXPANDER, PUMP, AND COMPRESSOR FOR OPERATING ACCORDING TO A RANKINE, AN ORGANIC RANKINE, HEAT PUMP, OR COMBINED ORGANIC RANKINE AND HEAT PUMP CYCLE

CROSS REFERENCE TO RELATED APPLICATIONS

This application is a continuation-in-part patent application to patent application having Ser. No. 15/731,929, filed on Aug. 24, 2017, which was a continuation patent application to the continuation patent application having Ser. No. 14/756,594, filed on Sep. 22, 2015, which claims priority as a continuation to the patent application having Ser. No. 13/986,349, filed on Apr. 23, 2013, which claims priority to the provisional patent application having Ser. No. 61/687,464, filed on Apr. 25, 2012, which latter application claims priority as a continuation-in-part patent application to the patent application having Ser. No. 13/507,779, filed on Jul. 30, 2012, now Publication No. US 2013-0036762 A1, which claims priority to the provisional patent application having Ser. No. 61/574,771, filed Aug. 9, 2011.

FIELD OF THE DISCLOSURE

The present disclosure is directed to an energy cycle construction, several rotating components of which are integrated within a compact container housing to share a common shaft along which working fluid transits as the construction operates.

The container housing is preferably of a generally cylindrical configuration with some combination of a scroll type expander, pump, and compressor disposed therein to form an integrated system, with the working fluid of the system circulating about a torus in the poloidal direction.

The assembled construction may operate generally as or in accordance with a Rankine Cycle, an Organic Rankine Cycle (ORC), a Heat Pump Cycle, an air conditioning or refrigeration cycle, or a Combined Organic Rankine and Heat Pump or refrigeration Cycle.

BACKGROUND

Rankine Cycles, Organic Rankine Cycles (ORC), and Refrigeration/Heat Pump Cycles are well known, and many systems of various designs have been developed over the years to operate in accordance with such cycles. For convenience of further reference, such cycles will often hereinafter be referred to generically as energy cycles. Principles of operation of such energy cycles have been addressed in detail in numerous prior publications, and operations of various systems in accordance with such energy cycles are also explained in numerous prior art publications. For convenience of further reference, such systems or constructions are often hereinafter referred to as energy cycle constructions.

Although such energy cycle constructions may take many forms, it has been found advantageous in many instances to employ multiple rotating components as components of such energy cycle constructions to effect the desired energy cycles while realizing advantages attendant to the use of such rotating components. Such rotating components may include not only rotary equipment such as generators and motors, but also other rotary devices such as expanders, pumps, and compressors, as well as scroll type devices that include both compressor and expander functions such as are disclosed in U.S. Provisional Patent Application Ser. No. 61/574,771, filed Aug. 9, 2011. For convenience of further reference, such other rotary devices and the like are often hereinafter referred to generically as working fluid treatment devices, and reference to energy cycle devices is intended to encompass motors and generators and like equipment in addition to working fluid treatment devices, especially as they may be utilized in energy cycle constructions.

Many energy cycle constructions are thus configured to operate as or in accordance with a Rankine Cycle, an Organic Rankine Cycle (ORC), and/or a Refrigeration/Heat Pump Cycle, and to employ one or more, and often two, rotary working fluid treatment devices, often of a scroll type design, as part of their systems. Generally, many such rotary based energy cycle constructions share a common set up in that they include two rotary working fluid treatment devices as well as an evaporator and condenser, and a motor or generator. Typically, such energy cycle constructions are constructed with the individual components thereof interconnected to form the completed system, but with each of such individual components existing as a separate independent component in a closed loop connected via piping. Due to the independence and separateness of such components, such completed or assembled energy cycle constructions have necessarily been of larger size. Also, traditionally the main components of the ORC such as the expander or "turbine", the pump, the condenser, the evaporator, and the generator are arranged separately on a skid or in an enclosing box. These components are connected by piping and power transmitting couplings. The pump will have a separate drive motor and controls. The interconnecting piping must be soldered or brazed which has problems with contamination and is costly and labor intensive.

For many reasons, it would generally be desirable if the sizes, and cost of such energy cycle constructions could be decreased or minimized, and the reliability improved. To this point in time, however, that desire has remained largely unsatisfied.

SUMMARY

The device of the present disclosure has thus been developed to result in a more compact, lower cost, and more reliable energy cycle construction. The resulting construction integrates system components into a closed, preferably cylindrical, container housing, sometimes hereinafter referred to more simply as the container, within which container housing the working fluid flows about a torus in the poloidal direction. The rotary working fluid treatment devices utilize a scroll type design and rotate about a common shaft, with the evaporation and condensing processes being affected while the fluid is in transit between the rotary fluid treatment devices. This type of system design can be advantageously used for power generation through the use of a Rankine Cycle or ORC, or can be used for heat pumping through the use of a Refrigeration/Heat Pump Cycle, sometimes hereinafter referred to more simply as a Heat Pump Cycle or a Refrigeration Cycle.

In the following explanation of the disclosure, the word "Scroll" can refer to either the traditional orbiting scroll design, or to what is commonly referred to as a Spinning or Co-rotating scroll design.

For power generation, a preferred embodiment employs five (5) major components within the container housing, including an expander, generator, pump, condenser, and evaporator. A scroll expander is used to extract power from the working fluid and move it into the condenser, while a scroll liquid pump, or other rotating liquid pump, such as a gear or vane pump, is used to pump the working fluid through the evaporator. The pump, expander, and generator are aligned on the same shaft, with the evaporation process occurring inside the shaft and the condensation process occurring along the containment shell of the container housing. The end result of such preferred embodiment is the production of electrical energy by moving heat from a high temperature source to a low temperature source. The compact ORC device of the present disclosure is completely integrated with the expander, the generator, and the pump all on a common central shaft and the evaporator arranged around the common central shaft within the pressure boundary. A condenser may be arranged externally around the compact ORC device or the condenser can be located elsewhere to utilize geothermal or liquid cooling. Further, the compact ORC device disclosed herein is of a compact design being at least one third the size of a traditional ORC device.

For an ORC, refrigerant can be used as the working fluid to extract heat from a variety of waste heat applications, such as solar power, geothermal, or waste heat from power production or manufacturing processes. For a Rankine Cycle, steam can be used as the working fluid to extract heat from burning fossil fuels or high temperature geothermal.

For heat pumping/refrigeration, a preferred embodiment also employs five (5) major components within the container housing, including a compressor, motor, expander, condenser, and evaporator, although the expander could be replaced with a capillary tube or expansion valve as used in a traditional heat pump/refrigeration cycle. A scroll compressor is used to compress the working fluid from the evaporator and to supply it to the condenser, while a scroll expander is used to expand the liquid from the condenser and to supply it as a two-phase gas to the evaporator. The expander, compressor, and motor are located on the same shaft, with the condensation process occurring inside the shaft and the evaporation process occurring along the containment shell of the container housing. The end result of such preferred embodiment is the use of electrical energy to move heat from a low temperature source to a high temperature source.

For a heat pump cycle, refrigerant can be used as the working fluid to move heat from ambient air to a heated area. For a refrigeration cycle, refrigerant can be used to remove heat from a cooled area to the ambient air.

Another system variation can be readily realized through the integration into a common construction of both an ORC and a refrigeration cycle, with the ORC being utilized to power the refrigeration cycle. Depending upon the net power difference, either a generator (excess power generated from ORC) or motor (deficiency in power generation from ORC) or combination motor and generator can be used. A preferred form of such system includes six (6) major components within the container housing, including a compressor-expander, a motor/generator, a pump-expander, high and low pressure evaporator portions, and a condenser, certain components of which may be designed to operate in accordance with U.S. Provisional Patent Application Ser. No. 61/574,771, filed Aug. 9, 2011.

In such system, the compressor-expander has two functions: on the outer portion of such compressor-expander refrigerant from the low pressure evaporator is compressed to be provided to the intermediate pressure condenser; on the inner portion of such compressor-expander refrigerant from the high pressure evaporator is expanded to be provided to the intermediate pressure condenser. The pump-expander also has two functions: on the outer portion of such pump-expander liquid refrigerant from the intermediate pressure condenser is expanded to be provided to the low pressure evaporator; on the inner portion of the pump-expander the liquid refrigerant from the intermediate pressure condenser is pumped to the high pressure evaporator. The compressor-expander, motor/generator, and pump-expander are all located on the same shaft. The high pressure evaporation process occurs inside the hollow shaft while the intermediate pressure condensation process occurs along the inside of the containment shell. The low pressure evaporation process occurs in an evaporator external to the containment shell inside a cooled space.

The present disclosure may thus be encompassed within and practiced by various constructions that incorporate all the rotary components within a single container housing, including systems such as the three (3) unique, preferred constructions noted hereinabove. Such design decreases the risk of refrigerant leakage, reduces overall system cost, due to the integration of components, and simplifies the energy cycle, which increases reliability, by eliminating all piping between components.

In addition, the unique design of such systems increases system efficiency and decreases system complexity, including by placing all the rotating equipment on a single shaft. For a refrigeration/heat pump cycle the design increases efficiency by replacing an expansion valve with an expander to recover power in the expansion process.

Although the preferred construction is described here, it may be necessary in some cases to place some of the components discretely in some ORC, heat pump and refrigeration cycle applications. Such alternate configurations are obvious and included herein.

DESCRIPTION OF THE PREFERRED EMBODIMENT

Figure 1:
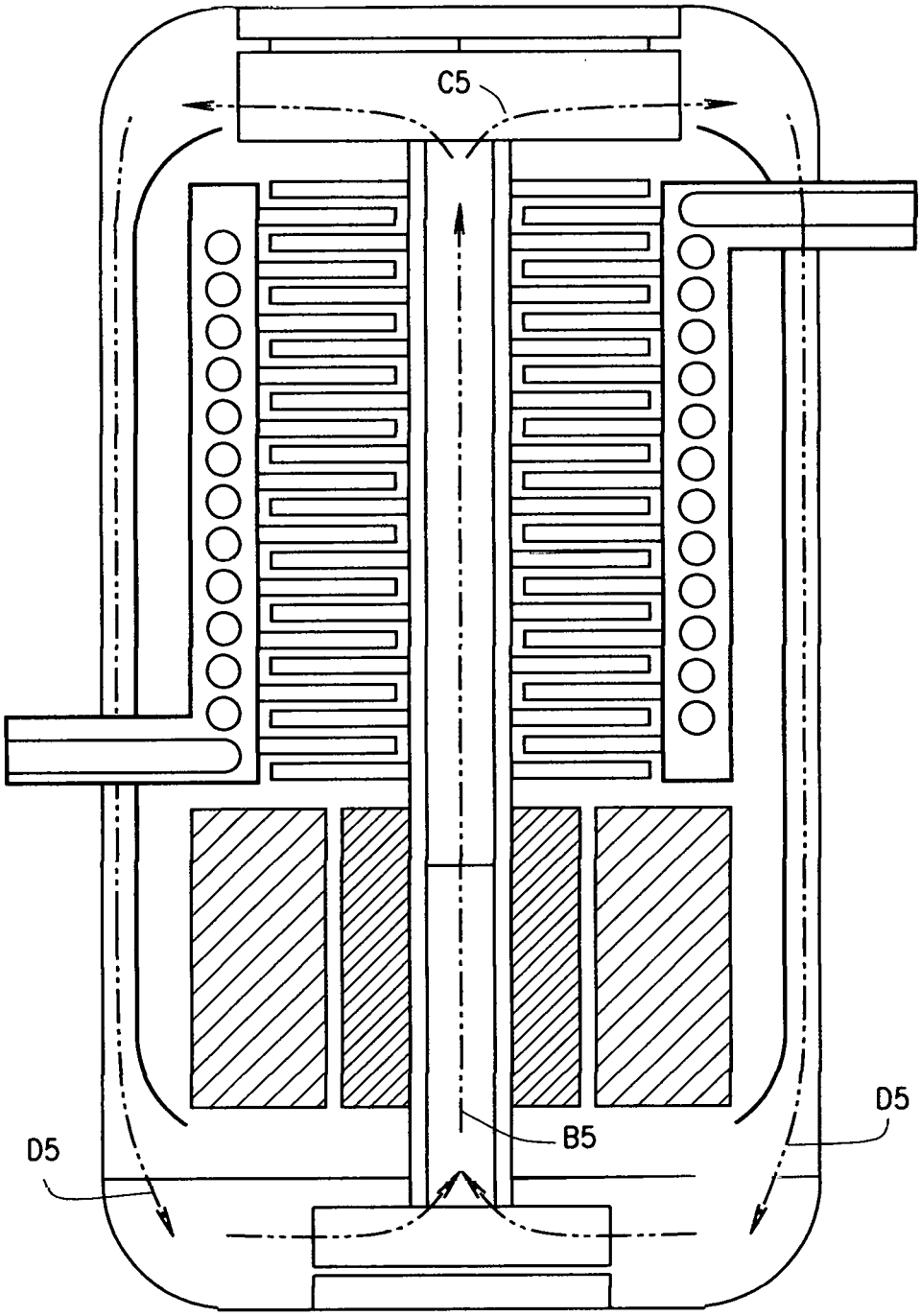
FIG. 1 depicts a preferred embodiment of the present device incorporated within a compact housing, operating as or in accordance with a Rankine Cycle or Organic Rankine Cycle (ORC)

With reference now to the drawings, where like identification symbols in any given figure refer to like items, but where such identification symbols may vary from figure to figure, FIG. 1 illustrates an embodiment according to the present disclosure, operating as or in accordance with a Rankine Cycle or Organic Rankine Cycle, with components and features of such embodiment having the identification symbols as set forth in the following Table 1:

TABLE 1

| FIG. 1 Identifiers | |
|---|---|
| Identifier | Item Description |
| Components (Alphabetized circles) | |
| A | Orbiting portion of the orbital scroll expander, or driving portion of a co-rotating scroll expander |
| B | Fixed portion of the orbital scroll expander, or driven portion of a co-rotating scroll expander |
| C | Scroll expander Outlet |
| D | Insulation/sealing between condenser and rotating equipment |
| E | Scroll pump inlet |
| F | Driving portion of a co-rotating scroll pump |
| G | Driven portion of a co-rotating scroll pump |
| H | Scroll pump outlet |
| I | Rotating shaft connecting pump to expander |
| J | Generator rotor |
| K | Generator stator |
| L | Heat transfer fins transferring heat between (I) and (N) |
| M | Heat source fluid inlet |
| N | Spiral fluid path for heat source fluid |
| O | Heat source fluid outlet |
| P | Scroll expander inlet |
| Q | Containment shell housing all components (can include fins on outside) |
| State Points between Components (Numbered Squares) | |
| 1 | Low pressure liquid refrigerant after condensation and before pumping |
| 2 | High pressure liquid refrigerant after pumping and before evaporation |
| 3 | High pressure refrigerant gas, after evaporation and before expansion |
| 4 | Low pressure single or two phase refrigerant gas after expansion before condensation |

TABLE 1-continued

| FIG. 1 Identifiers | |
|---|---|
| Identifier | Item Description |
| Processes (broken lines) | |
| A5 | Pumping process |
| B5 | Evaporation process |
| C5 | Expansion process |
| D5 | Condensation process |

From the foregoing, it should be apparent to those skilled in the art that the scroll expander of FIG. 1 thus comprises the components marked therein by the identification symbols circled-A through circled-C and circle-P, that the scroll pump comprises circled-F through circled-H, and that the generator comprises circled-J through circled-K. It should be further apparent that the pumping process, marked or designated in FIG. 1 and by the foregoing as A5, occurs between numbered-square-1 and numbered-square-2; that the evaporation process, marked or designated in FIG. 1 and by the foregoing as B5, occurs between numbered-square-2 and numbered-square-3; that the expansion process, marked or designated in FIG. 1 and by the foregoing as C5, occurs between numbered-square-3 and numbered-square-4; and that the condensation process, marked or designated in FIG. 1 and by the foregoing as D5, occurs between numbered-square-1 and numbered-square-2.

Figure 5:
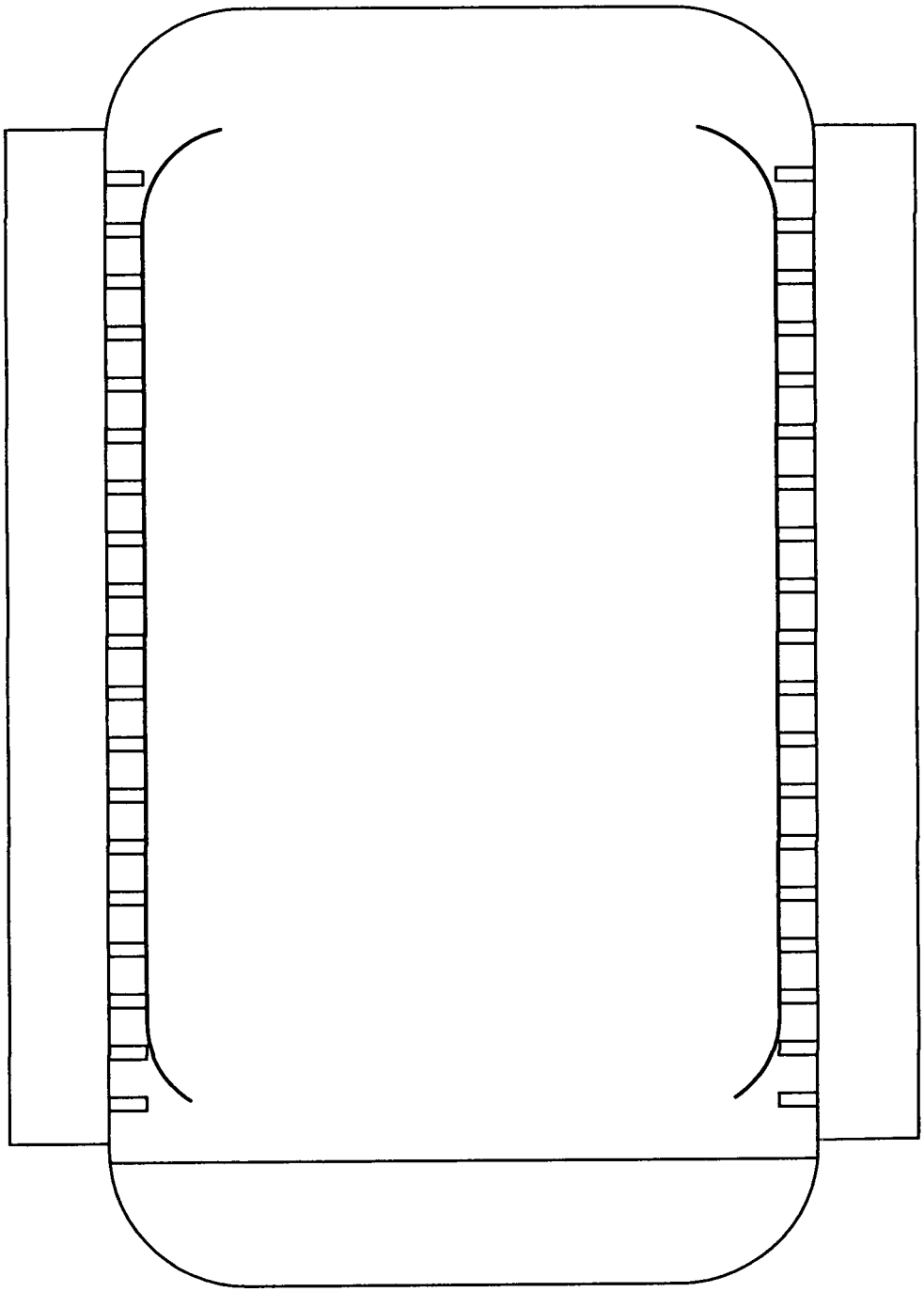
FIG. 5 shows a preferred housing fin configuration that can optionally be employed with the embodiments shown in FIGS. 1-4.
Figure 6:
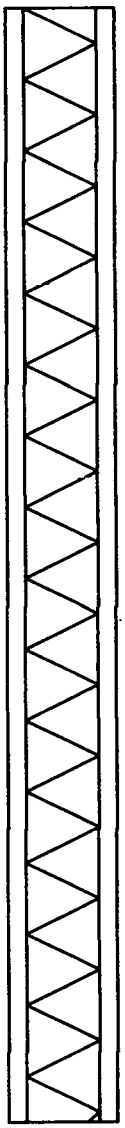
FIG. 6 shows several rotating shaft fin configurations that can be optionally employed with hollow shaft components such as are employed with the preferred embodiments shown in FIGS. 1-3.
Figure 6:
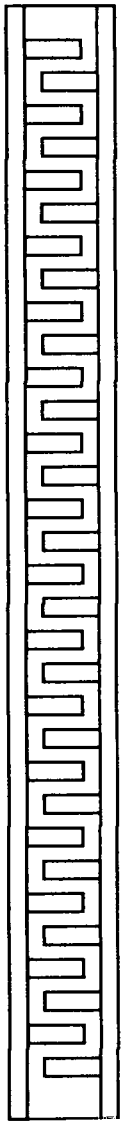

The design and operation of individual components of such construction are well known and those skilled in the art will appreciate and understood from FIGS. 1, 5, and 6, and from the Tables associated therewith and the discussions herein, how the various components are connected to one another to be operable and integrated within a common container, with various rotating components sharing a common shaft through which the working fluid flows while transiting between certain of the component devices.

The scroll expander operates to extract power from the working fluid provided thereto at numbered-square-3 and to move the working fluid into the condenser, as at numbered-square-4, while the scroll liquid pump operates to pump the working fluid provided from the condenser at numbered-square-1 to the evaporator at numbered-square-2 and through the evaporator to numbered-square-3. The pump, expander, and generator are aligned on the same shaft, with the evaporation process occurring inside the shaft and the condensation process occurring along the containment shell of the container housing. The end result of such preferred embodiment is the production of electrical energy by moving heat from a high temperature source to a low temperature source.

Figure 2:
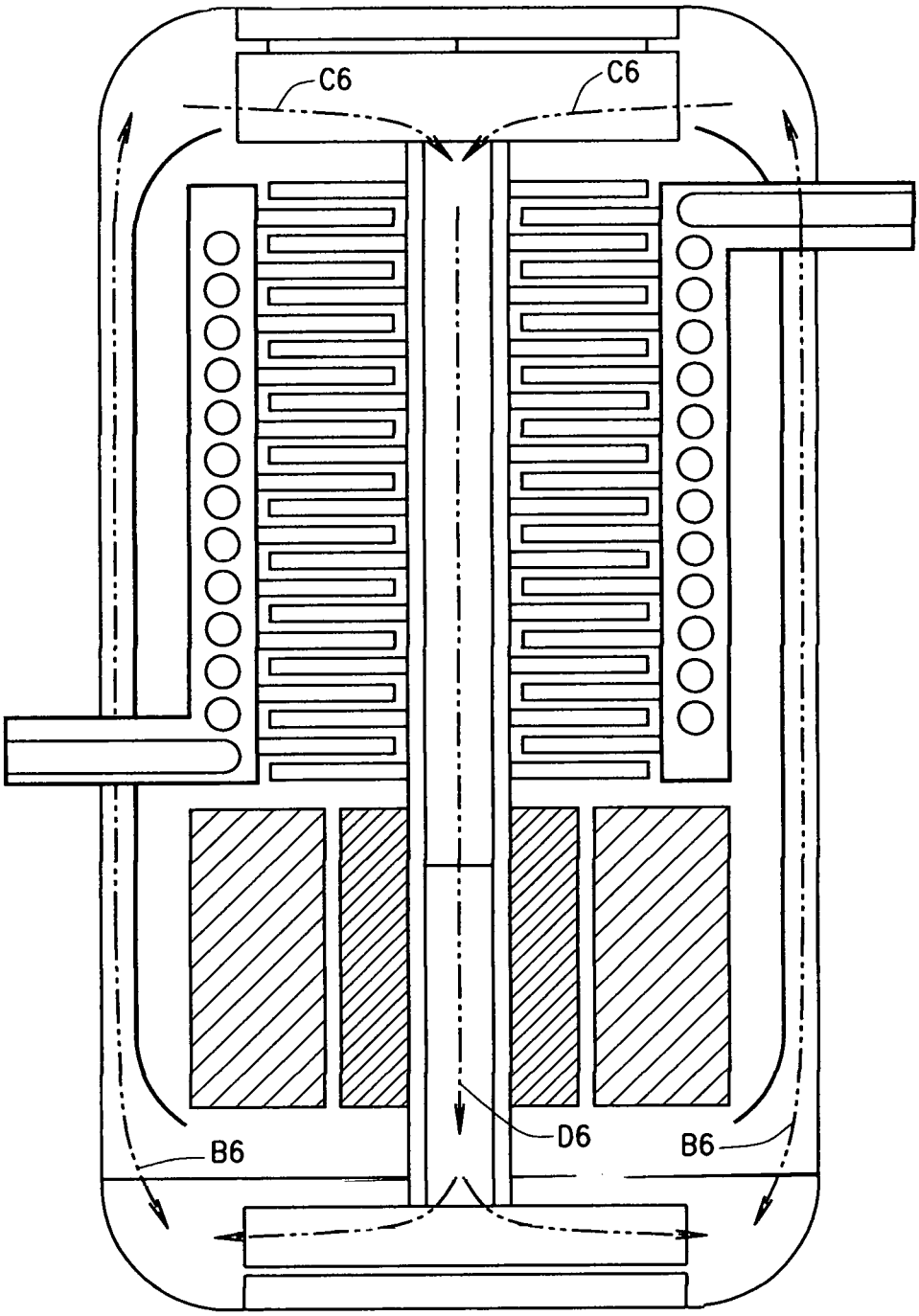
FIG. 2 depicts a preferred embodiment of the present device as incorporated within a compact housing, operating as or in accordance with a Heat Pump or Refrigeration Cycle.

FIG. 2 depicts a preferred embodiment of the present disclosure, operating as or in accordance with a Heat Pump or Refrigeration Cycle, with components of such embodiment having the identification symbols as set forth in the following Table 2:

TABLE 2

| FIG. 2 Identifiers | |
|---|---|
| Identifier | Item Description |
| Components (Alphabetized circles) | |
| A | Orbiting portion of an orbital scroll compressor, or driving portion of a co-rotating scroll compressor |

TABLE 2-continued

| FIG. 2 Identifiers | |
|---|---|
| Identifier | Item Description |
| B | Fixed portion of an orbital scroll compressor, or driven portion of a co-rotating scroll compressor |
| C | Scroll compressor inlet |
| D | Insulation/sealing between evaporator and rotating equipment |
| E | Scroll liquid expander outlet |
| F | Driving portion of a co-rotating scroll liquid expander, or capillary tube or expansion valve |
| G | Driven portion of a co-rotating scroll liquid expander |
| H | Scroll liquid expander inlet |
| I | Rotating shaft connecting compressor to liquid expander |
| J | Motor rotor |
| K | Motor stator |
| L | Heat transfer fins transferring heat between (I) and (N) |
| M | Heat sink fluid inlet |
| N | Spiral fluid path for heat sink fluid |
| O | Heat sink fluid outlet |
| P | Scroll compressor outlet |
| Q | Containment shell housing all components (can include fins on outside) |
| State Points between Components (Numbered Squares) | |
| 1 | Low pressure refrigerant gas after evaporation and before compression |
| 2 | High pressure refrigerant gas after compression and before condensation |
| 3 | High pressure liquid refrigerant after condensation and before expansion |
| 4 | Low pressure two phase refrigerant gas after expansion before evaporation |
| Processes (broken lines) | |
| A6 | Expansion process |
| B6 | Evaporation process |
| C6 | Compression process |
| D6 | Condensation process |

From the foregoing, it should be apparent to those skilled in the art that the scroll compressor of FIG. 2 thus comprises the components marked therein by the identification symbols circled-A through circled-C and circle-P, that the scroll expander comprises circled-F through circled-H, and that the motor comprises circled-J through circled-K. It should be further apparent that the expansion process, marked or designated in FIG. 2 and by the foregoing as A6, occurs between numbered-square-3 and numbered-square-4; that the evaporation process, marked or designated in FIG. 2 and by the foregoing as B6, occurs between numbered-square-4 and numbered-square-1; that the compression process, marked or designated in FIG. 2 and by the foregoing as C6, occurs between numbered-square-1 and numbered-square-2; and that the condensation process, marked or designated in FIG. 2 and by the foregoing as D6, occurs between numbered-square-2 and numbered-square-3.

The design and operation of individual components of such construction are well known and those skilled in the art will appreciate and understood from FIGS. 2, 5, and 6, and from the Tables associated therewith and the discussions herein, how the various components are connected to one another to be operable and integrated within a common container, with various rotating components sharing a common shaft through which the working fluid flows while transiting between certain of the component devices.

The scroll compressor operates to compress the working fluid provided thereto from the evaporator at numbered-square-1 and to move the working fluid into the condenser, as at numbered-square-2, while the scroll expander operates to expand the working fluid provided as a liquid from the condenser at numbered-square-3 and to provide it to the evaporator at numbered-square-4 as a two-phase gas. The expander, compressor, and motor are aligned on the same shaft, with the condensation process occurring inside the shaft and the evaporation process occurring along the containment shell of the container housing. The end result of such preferred embodiment is the use of electrical energy to move heat from a low temperature source to a high temperature source. For a heat pump cycle, refrigerant can be used as the working fluid to move heat from ambient air to a heated area. For a refrigeration cycle, refrigerant can be used to remove heat from a cooled area to the ambient air.

With reference now to both FIGS. 3 and 4, there is shown a preferred embodiment of the present disclosure as incorporated within a compact housing, operating as or in accordance with a Combined Refrigeration and Organic Rankine Cycle, with components of such embodiment having the identification symbols as set forth in the following Table 3:

TABLE 3

Figure 3:
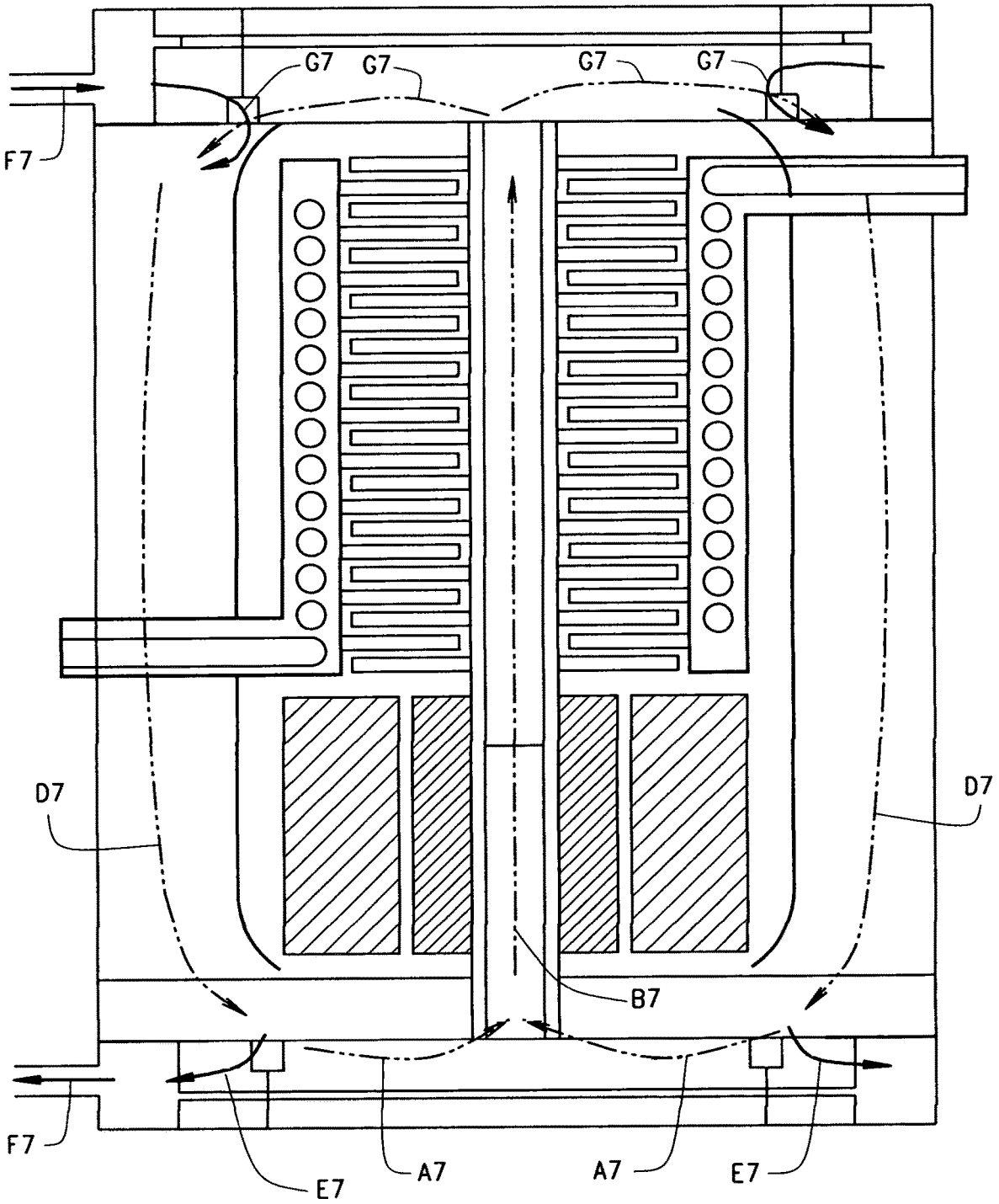
FIG. 3 depicts a preferred embodiment of the present device as incorporated within a compact housing, operating as or in accordance with a Combined Refrigeration and Organic Rankine Cycle (ORC)
Figure 4:
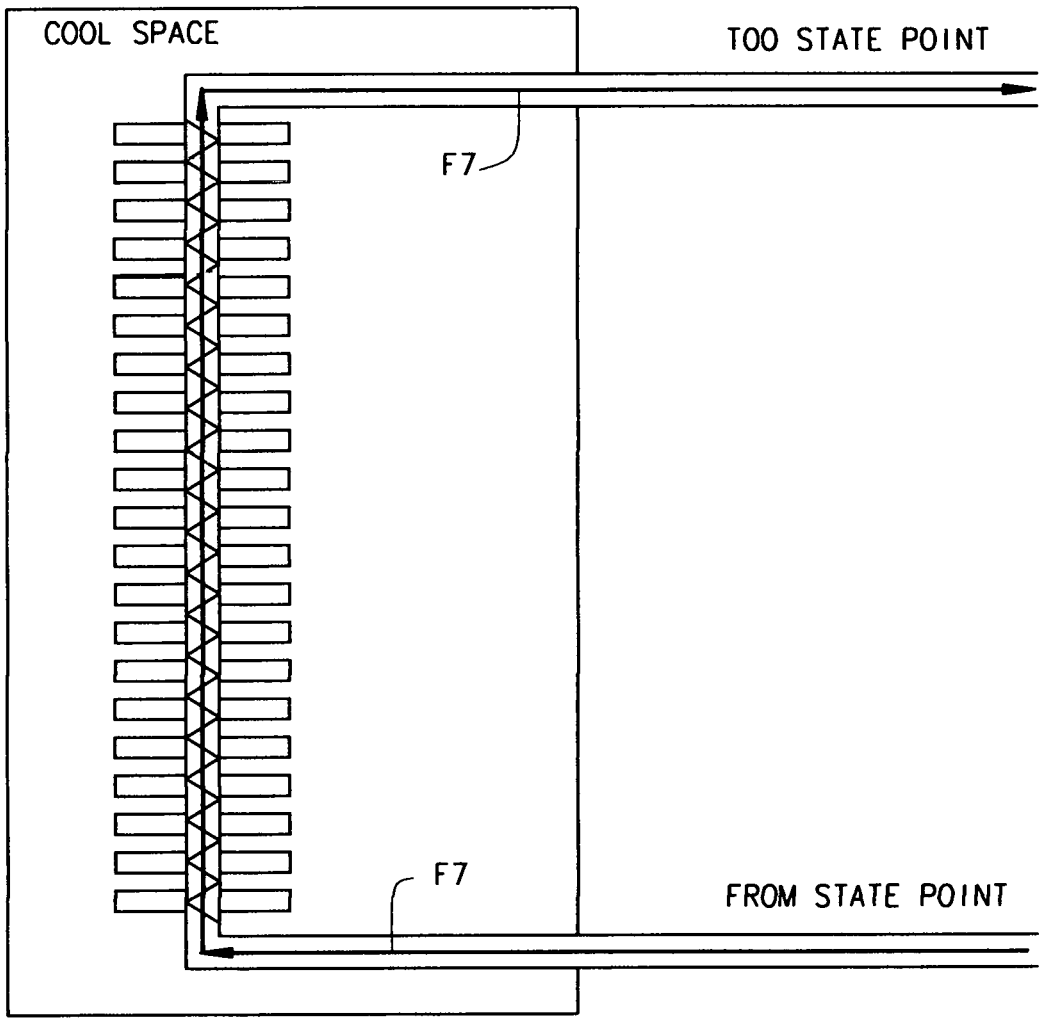
FIG. 4 depicts a preferred embodiment of the present device as incorporated within a compact housing, operating as or in accordance with a Combined Refrigeration and Organic Rankine Cycle (ORC)

| FIGS. 3 and 4 Identifiers | |
|---|---|
| Identifier | Item Description |
| Components (Alphabetized circles) | |
| A1 | Rotating or orbital expander portion of the scroll compressor-expander |
| B1 | Fixed or co-rotating expander portion of the scroll compressor-expander |
| A2 | Rotating or orbital compressor portion of the scroll compressor-expander |
| B2 | Fixed or co-rotating compressor portion of the scroll compressor-expander |
| C | Scroll compressor-expander outlet |
| D | Insulation/sealing between condenser and rotating equipment |
| E | Scroll pump-expander inlet |
| F1 | Rotating pump portion of the scroll pump-expander |
| G1 | Fixed pump portion of the scroll pump-expander |
| F2 | Rotating expander portion of the scroll pump-expander |
| G2 | Fixed expander portion of the scroll pump-expander |
| H1 | Scroll pump outlet or the pump-expander |
| H2 | Scroll expander outlet or the pump-expander |
| I | Rotating shaft connecting pump-expander to compressor-expander |
| J | Generator/motor rotor |
| K | Generator/motor stator |
| L | Heat transfer fins transferring heat between (I) and (N) |
| M | Heat source fluid inlet |
| N | Spiral fluid path for heat source fluid |
| O | Heat source fluid outlet |
| P1 | Scroll expander inlet of the compressor-expander |
| P2 | Scroll compressor inlet of the compressor-expander |
| Q | Containment shell housing all components (can included fins on outside) |
| R1 | Insulation/sealing between compressor inlet and condensation process |
| R2 | Insulation/sealing between expander outlet and condensation process |
| S | Low pressure evaporator |
| T | Low pressure evaporator external fin configuration |
| U | Low pressure evaporator internal spiral fin configuration |
| State Points between Components (Numbered Squares) | |
| 1 | Intermediate pressure liquid refrigerant after condensation and before pumping or expansion |
| 2a | High pressure liquid refrigerant after pumping and before high pressure evaporation |
| 2b | Low pressure two phase refrigerant gas after expansion and before low pressure evaporation |
| 3a | High pressure refrigerant gas after high pressure evaporation and before expansion |
| 3b | Low pressure refrigerant gas after low pressure evaporation and before compression |
| 4 | Low pressure refrigerant gas after expansion or |

TABLE 3-continued

| FIGS. 3 and 4 Identifiers | |
|---|---|
| Identifier | Item Description |
| | compression and before condensation Processes (Colored broken/solid lines) |
| A7 (broken line) | Intermediate pressure to high pressure pumping process |
| B7 (broken line) | High pressure evaporation process |
| C7 (broken line) | High pressure to intermediate pressure expansion process |
| D7 (broken line) | Intermediate condensation process |
| E7 (solid line) | Intermediate pressure to low pressure expansion |
| F7 (solid line) | Low pressure evaporation process |
| G7 (solid line) | Low pressure to intermediate pressure compression |

From the foregoing, it should be apparent to those skilled in the art that the scroll compressor-expander of FIGS. 3 and 4, which may take a form as disclosed in U.S. Provisional Patent Application Ser. No. 61/574,771, filed Aug. 9, 2011, thus comprises the components marked therein by the identification symbols circled-A1 through circled-B1, circled-A2 through circled-B2, circled-C, and circled-P1 through circled-P2; that the scroll pump-expander, which may also take a form as disclosed in U.S. Provisional Patent Application Ser. No. 61/574,771, filed Aug. 9, 2011, comprises circled-F1 through circled-H1 and circled-F2 through circled-H2; and that the generator/motor comprises circled-J through circled-K.

It should be further apparent that the intermediate pressure to high pressure pumping process, marked or designated in FIG. 3 and by the foregoing as A7 (broken line), occurs between numbered-square-1 and numbered-square-2a; that the high pressure evaporation process, marked or designated in FIG. 3 and by the foregoing as B7 (broken line), occurs between numbered-square-2a and numbered-square-3a; that the high pressure to intermediate pressure expansion process, marked or designated in FIG. 3 and by the foregoing as C7 (broken line), occurs between numbered-square-3a and numbered-square-4; that the intermediate condensation process, marked or designated in FIG. 3 and by the foregoing as D7 (broken line), occurs between numbered-square-4 and numbered-square-1; that the intermediate pressure to low pressure expansion process, marked or designated in FIG. 3 and by the foregoing as E7 (solid line), occurs between numbered-square-1 and numbered-square-2b; that the low pressure evaporation process, marked or designated in FIGS. 3 and 4 and by the foregoing as F7 (solid line), occurs between numbered-square-2b on FIG. 3 and through FIG. 4 back to numbered-square-3b on FIG. 3; and that the low pressure to intermediate pressure compression process, marked or designated in FIG. 3 and by the foregoing as G7 (solid line), occurs between numbered-square-3b and numbered-square-4.

The design and operation of individual components of such construction are known from the prior art and/or from U.S. Provisional Patent Application Ser. No. 61/574,771, filed Aug. 9, 2011, incorporated herein by reference thereto, and those skilled in the art will appreciate and understood from FIGS. 3-6, and from the Tables associated therewith and the discussions herein, how the various components are connected to one another to be operable and integrated within a common container, with various rotating components sharing a common shaft through which the working fluid flows while transiting between certain of the component devices.

The outer portion of the compressor-expander of FIG. 3 operates to compress refrigerant provided thereto at numbered-square-3b on FIG. 3 from the low pressure evaporator of FIG. 4 and to provide the compressed refrigerant to the intermediate pressure condenser at numbered-square-4 on FIG. 3, while the inner portion of such compressor-expander operates to expand refrigerant provided thereto at numbered-square-3a on FIG. 3 from the high pressure evaporator and to provide the expanded refrigerant to the intermediate pressure condenser at numbered-square-4. The manner in which both of such operations are affected by the compressor-expander of FIG. 3 is explained in greater detail in U.S. Provisional Patent Application Ser. No. 61/574,771, filed Aug. 9, 2011, which is incorporated herein by reference thereto.

Somewhat similarly, the outer portion of the pump-expander of FIG. 3 operates to expand liquid refrigerant provided at numbered-square-1 from the intermediate pressure condenser and to provide such expanded refrigerant at numbered-square-2b to the low pressure evaporator (FIG. 4), while the inner portion of such pump-expander operates to pump the liquid refrigerant provided thereto at numbered-square-1 to the high pressure evaporator at numbered-square-2a. The manner in which both of such operations are affected by the pump-expander of FIG. 3 is also explained in greater detail in U.S. Provisional Patent Application Ser. No. 61/574,771, filed Aug. 9, 2011, which is incorporated herein by reference thereto.

As can be observed from FIG. 3, the compressor-expander, motor/generator, and pump-expander are all located on the same shaft. The high pressure evaporation process occurs inside the hollow shaft while the intermediate pressure condensation process occurs along the inside of the containment shell. The low pressure evaporation process occurs in an evaporator component shell inside a cooled space, which may typically be located external to the containment, such as shown in FIG. 4, but which could also, with some redesign and/or segmentation of the areas within the containment shell between the outer housing circled-Q and the insulation circled-D, be included within such outer housing.

FIG. 5 shows a preferred housing fin configuration that can optionally be employed with the embodiments of FIGS. 1-4, with components thereof having the identification symbols as set forth in the following Table 4:

TABLE 4

| FIG. 5 Identifiers for Housing Fin Configuration | |
|---|---|
| Identifier | Item Description |
| | Components (Alphabetized circles) |
| A | External horizontal fins attached to the containment shell (C) |
| B | Spiral fin between the inside wall of the containment shell (C) and the Insulation/sealing wall (D) |
| C | Containment Shell |
| D | Separation/sealing wall |

If desired by a user, an optional fin array construction circled-A can be readily added to the outside of the containment shell of FIG. 5. Although FIG. 5 shows a fin array construction in which a number of fins of a straight vertical fin configuration are disposed generally radially about the generally cylindrical containment shell circled-C, any suitable fin geometry/configuration could be utilized to optimize heat transfer. In addition, an external fan system (not shown) could optionally be included on the outside to add forced convection across the fin array.

A large spiral fin circled-B could also be added to the inside wall of the containment shell circled-C of FIG. 5. Although such fin is presented in FIG. 5 as being one fin having a spiral fin configuration, any fin geometry/configuration could be used to optimize heat transfer.

FIG. 6 shows several rotating shaft fin configurations that can be optionally employed with hollow shaft components such as are employed with the preferred embodiments of FIGS. 1-3, with the components thereof having the identification symbols as set forth in the following Table 5:

TABLE 5

| FIG. 6 Identifiers for Rotating Shaft Fin Configuration | |
|---|---|
| Identifier | Item Description |
| Components | |
| A | Spiral fin spanning the entire length of the rotating shaft |
| B | Offset fins spanning the entire length of the rotating shaft |

A spiral fin system or channel can also optionally be added inside the hollow shaft in order to increase heat transfer surface area. Such fin systems can take various forms, including the two preferred, alternative configurations depicted in FIG. 6 as Configurations A and B. The fin system of Configuration A includes one spiral fin along the entire length while the fin system of Configuration B includes a series of offset fins.

Various other and additional changes and modifications are also possible. Among the changes and modifications contemplated is the use with the low pressure evaporator of a set of both external and internal fins, depicted as components circled-T and circled-U in FIG. 4, to increase surface area. Such fins can be any configuration/geometry to optimize heat transfer. It is envisioned that, in at least some instances, an off the shelf evaporator could be used as the external low pressure evaporator component.

It is also envisioned that, in order to minimize overall cost, the expander of FIG. 2 could be replaced with a capillary tube. Although such a substitution would lower overall efficiency, it would lower system cost substantially. Similarly, the expander component in the pump-expander of FIG. 3 could be replaced with a capillary tube to decrease system cost.

Figure 7:
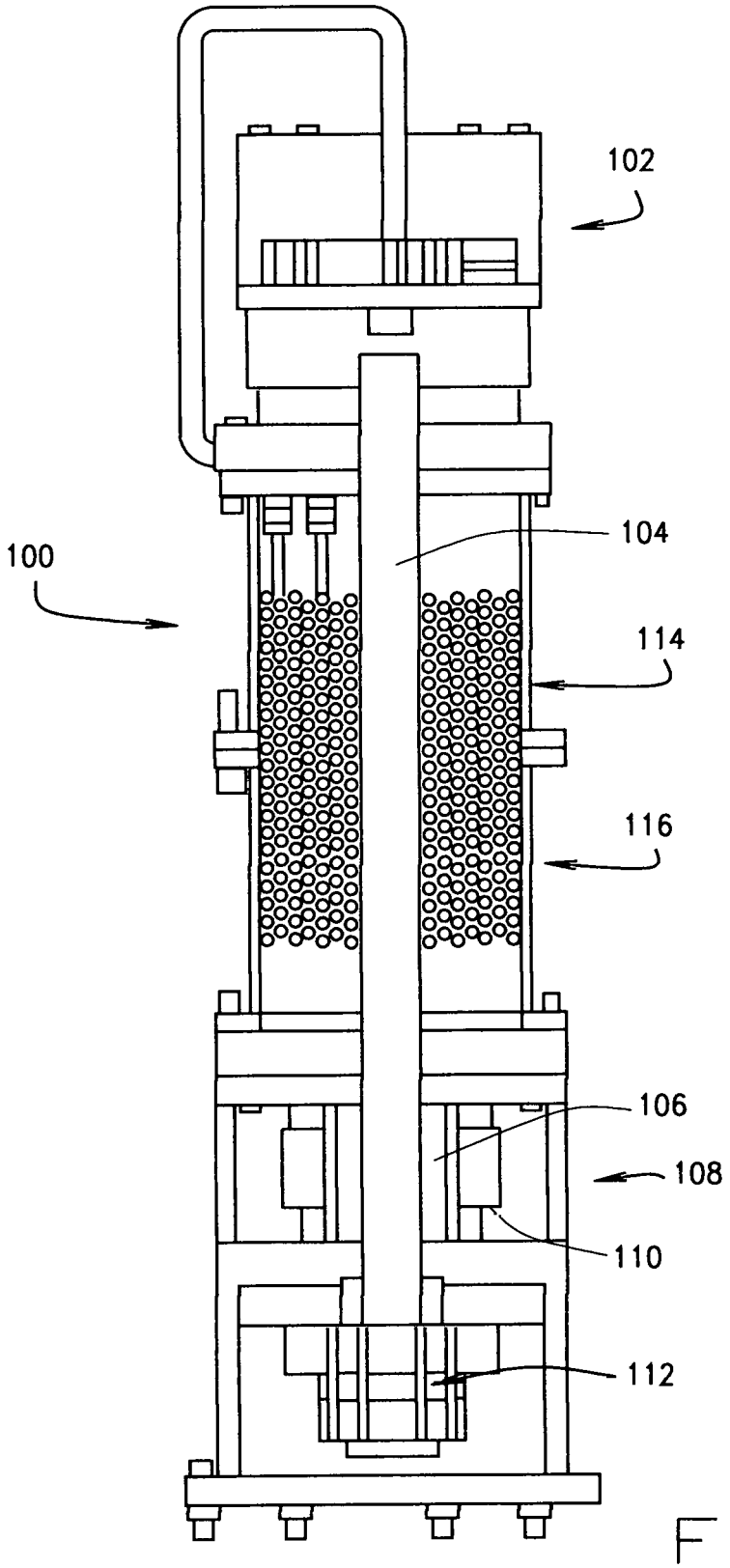
FIG. 7 is a cross-sectional view of another embodiment of a compact Organic Rankine Cycle device constructed according to the present disclosure.

With particular reference now to FIG. 7, an embodiment of a compact Organic Rankine Cycle (CORC) device 100 constructed according to the present disclosure is shown. The CORC device 100 comprises a scroll type expander such as an orbiting scroll type expander 102 and a central shaft 104 which is driven by the expander 102. The expander 102 may also be a spinning scroll or co-rotating scroll, or a vane type expander, or any other type of positive displacement expander. The central shaft 104 has mounted thereto a rotor 106 of a generator 108. The generator 108 also has a stator 110. The generator 108 may be an alternating current (AC) or a direct current (DC) type generator. A pump 112 is operated by rotation of the central shaft 104 which is driven by the expander 102. The pump 112 can be any positive displacement type liquid refrigerant pump, such as a scroll type, gear, or vane type pump. The CORC device 100 also has an evaporator 114 that is integrated within the CORC device 100. By having the evaporator 114 within the CORC device 100 there is no need for any external piping from the pump 112. The evaporator 114 may be tube type, extruded aluminum, or any other type evaportor. The CORC 100 has a housing 116 within which are the expander 102, the central shaft 104, the generator 108, the pump 112, and the evaporator 114. The CORC device 100 is of a compact design and is at least one third the size of a traditional Organic Rankine Cycle device. The CORC device 100 is completely integrated with the expander 102, the generator 108, and the pump 112 all on the central shaft 104 within a pressure boundary of the housing 116. Although not shown, it is possible and contemplated that a condensed working fluid may be routed around or near the generator 108 to cool the generator 108 and to recover heat losses from the generator 108. This will improve the efficiency of the generator 108 and the CORC device 100. Also, it is possible to incorporate integrated passages from the pump 112 to the generator 108 to the evaporator 114 so that no external piping is required. Integrated passages may also be incorporated from the evaporator 114 to an inlet of the expander 102.

Figure 8:
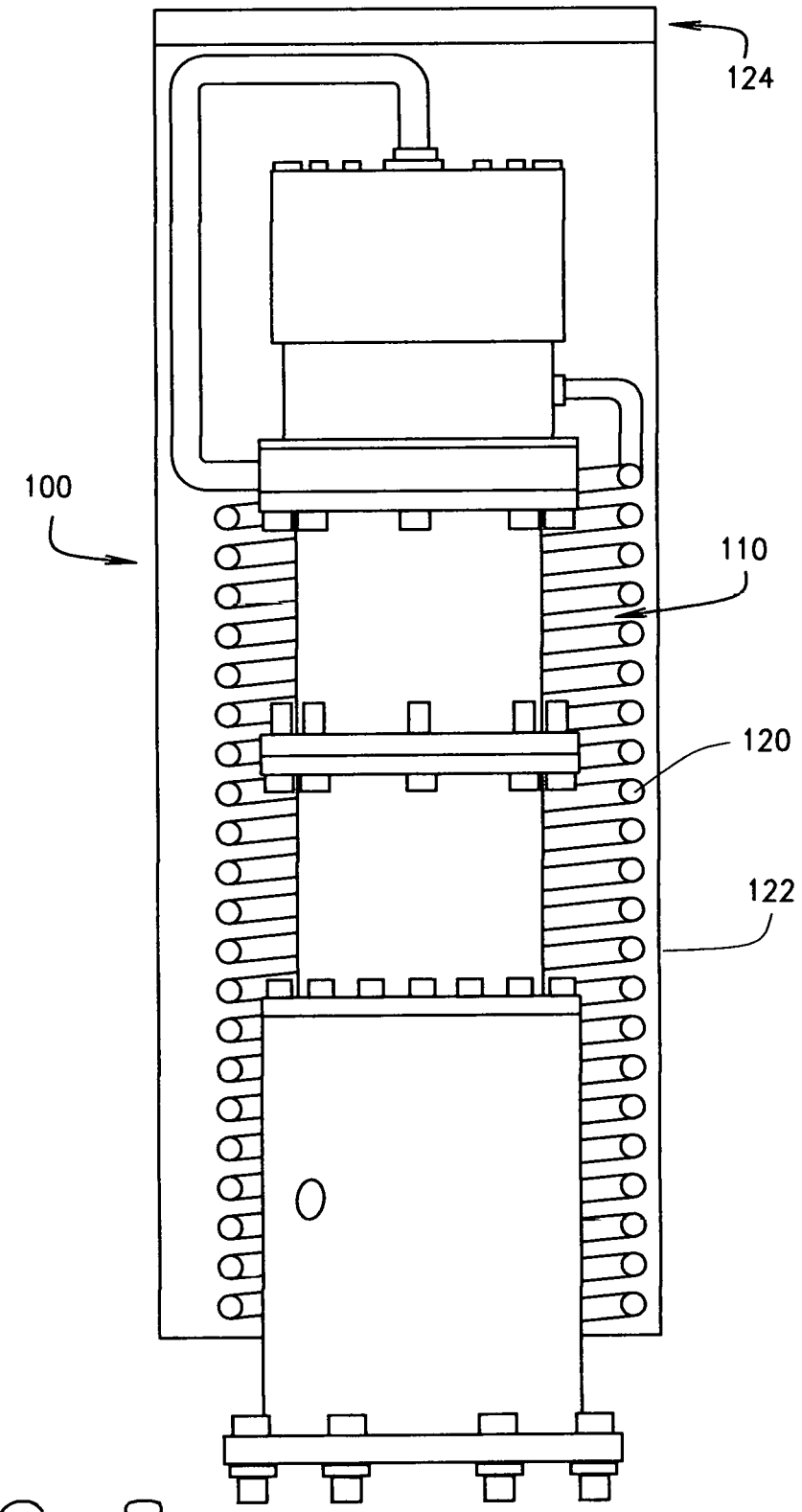
FIG. 8 is a perspective view of a compact Organic Rankine Cycle device having an external condenser constructed according to the present disclosure.

FIG. 8 illustrates the CORC device 100 having an optional external condenser 120 surrounding a portion of the housing 116. The optional external condenser 120 has a shroud 122 and a fan 124. The condenser 120 is easily integrated with the CORC device 100 to provide for a compact package containing all of the components of the CORC device 100. The condenser 120 is optional since other condenser methods such as geothermal or liquids may be employed. As can be appreciated, the housing 116 has enclosed therein the various components of the CORC device 100, such as the expander 102, the central shaft 104, the generator 108, the pump 112, and the evaporator 114, all of which are not visible in this particular view.

Figure 9:
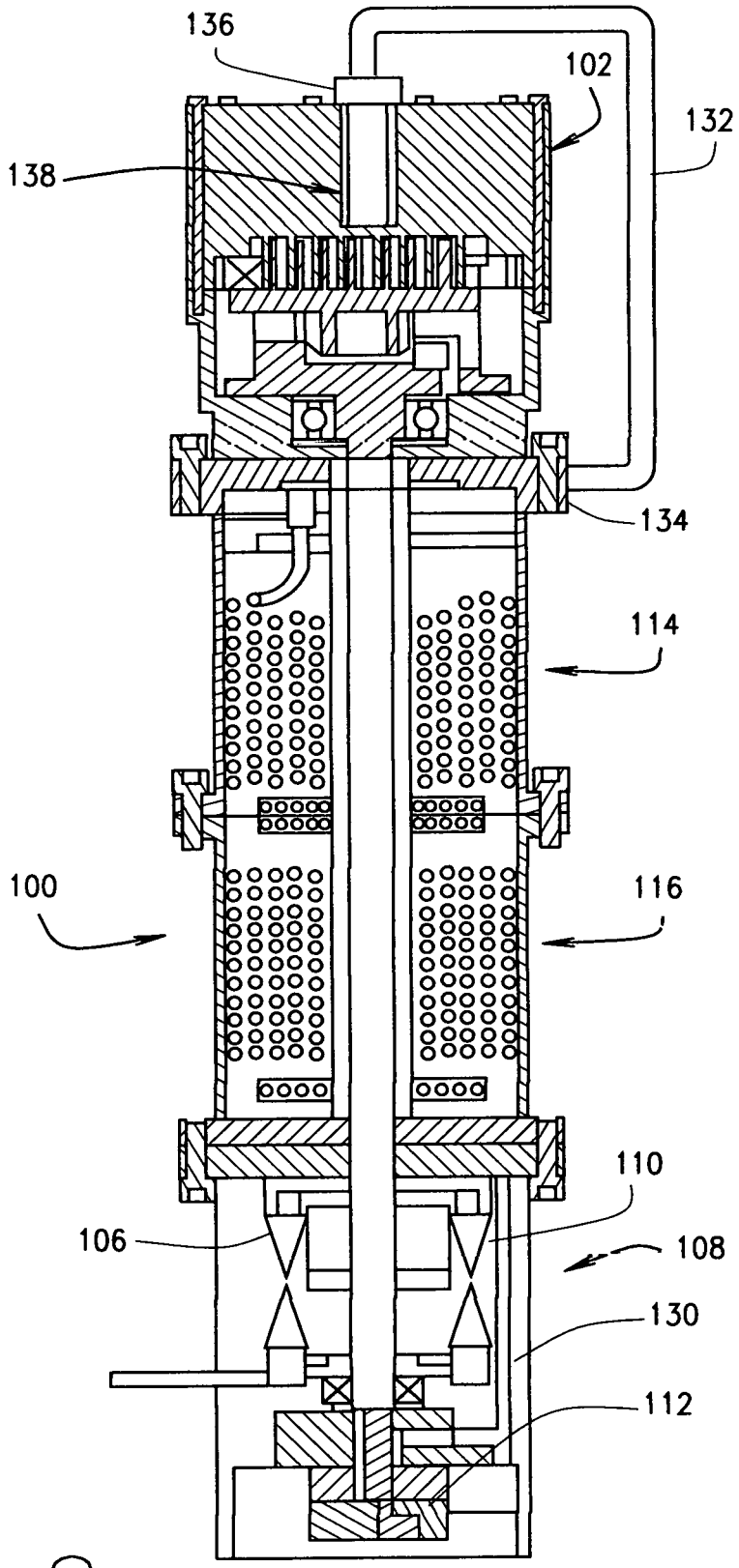
FIG. 9 is a cross-sectional view of a compact Organic Rankine Cycle device having a discharge constructed according to the present disclosure.

With reference now to FIG. 9, a cross-sectional view of the CORC device 100 is shown having a discharge 130 from the pump 112. The discharge 130 is integrated into the housing 116 and directed near the generator 108. The discharge 130 can also be in direct contact with the stator 110 of the generator 108. Either way the pump discharge fluid, the working fluid, is cooling the generator 108 for providing the generator 108 to operator more efficiently. Any heat loses from the generator 108 are captured by the working fluid recovering the losses from the generator 108. An external tube 132 is used to transport working fluid (not shown) from a discharge 134 of the evaporator 114 to an inlet 136 of the expander 102. However, the working fluid could just as easily be transported through internal passages (not shown) eliminating the external tube 132. An insulating tube 138 may be located at the inlet 136 of the expander 102 to further improve efficiency. The insulating tube 138 is optional. The evaporator 114 is shown in FIG. 9 as being a coiled type evaporator. The evaporator 114 may be of other designs or configurations, such as a finned tube type evaporator.

Figure 10:
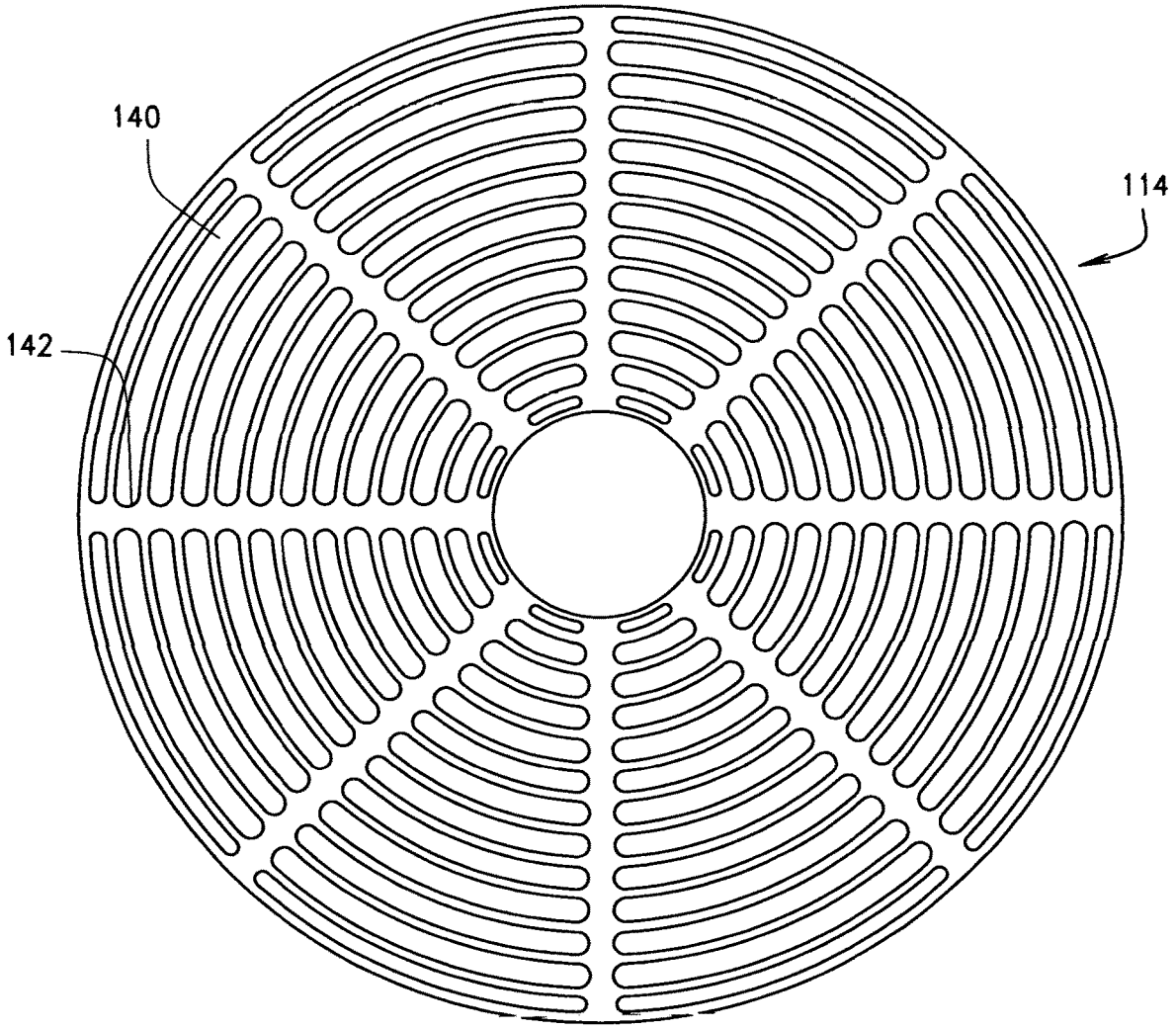
FIG. 10 is a top view of an evaporator being constructed of extruded aluminum that is used in the compact Organic Rankine Cycle device of the present disclosure.

FIG. 10 shows, as an alternative, the evaporator 114 being made of extruded aluminum. An extruded aluminum tube 140 having a cross section as shown in FIG. 10 could be cut off at an appropriate length to achieve the required or desired heat transfer. The extruded aluminum tube 140 may have brazed on aluminum end caps 142. The end caps 142 may have passages that alternately communicate with every other circular slot, carrying alternately the working fluid to be evaporated and the fluid from the heat source.

Figure 11:
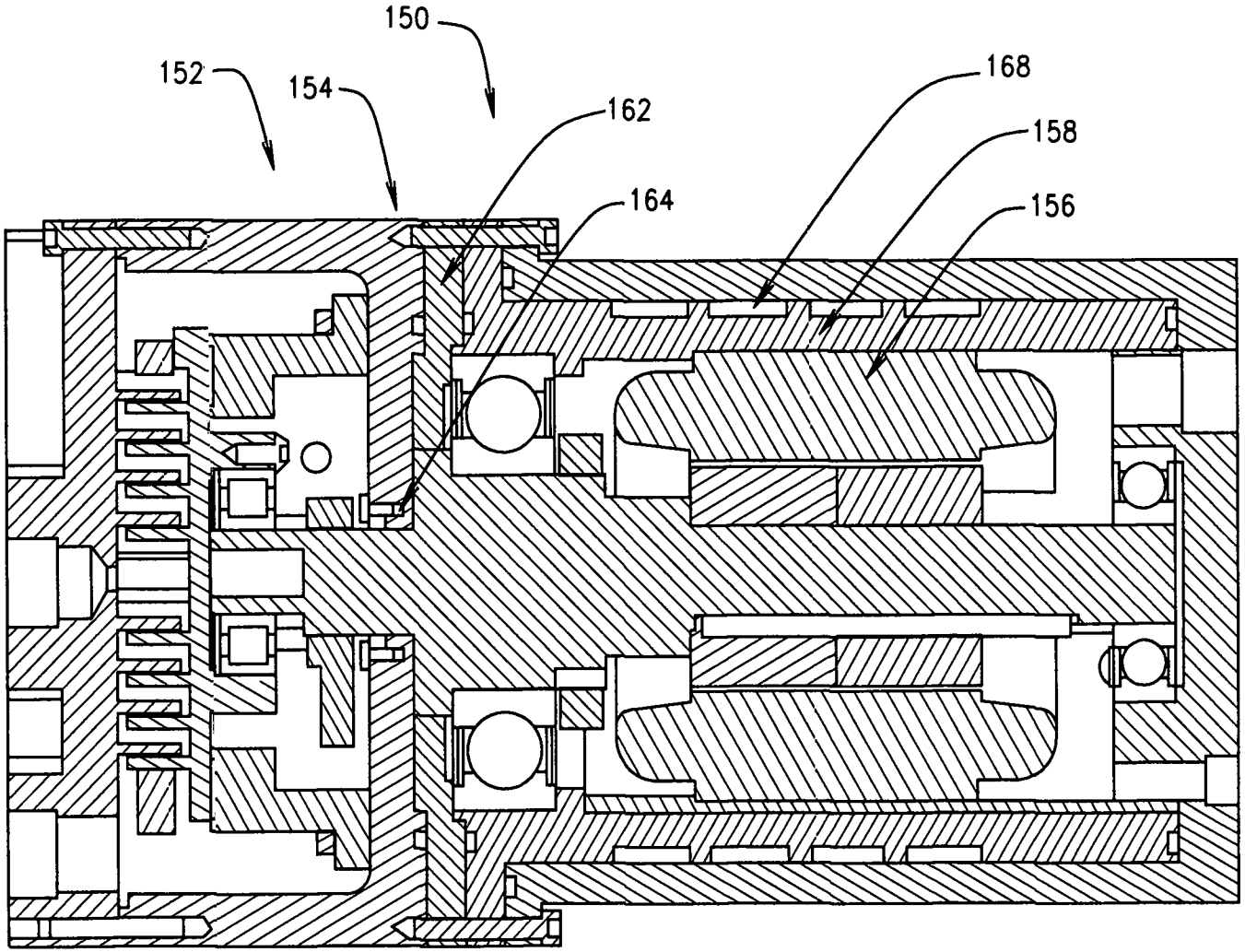
FIG. 11 is a cross-sectional view of another embodiment of a compact Organic Rankine Cycle device constructed according to the present disclosure.

Referring now to FIG. 11, a cross-sectional view of an CORC device 150 is shown in which a discharge 152 from a pump 154 is routed in such a way to cool a generator 156. Heat produced by the generator 156 is reclaimed from the generator 156 to improve the overall efficiency of the CORC device 150. The generator 156 also has a housing 158 having a passage 160 formed therein for allowing a refrigerant (not shown) to travel through the passage 160. The CORC device 150 also has a thermal barrier 162 and a shaft seal 164.

Figure 12:
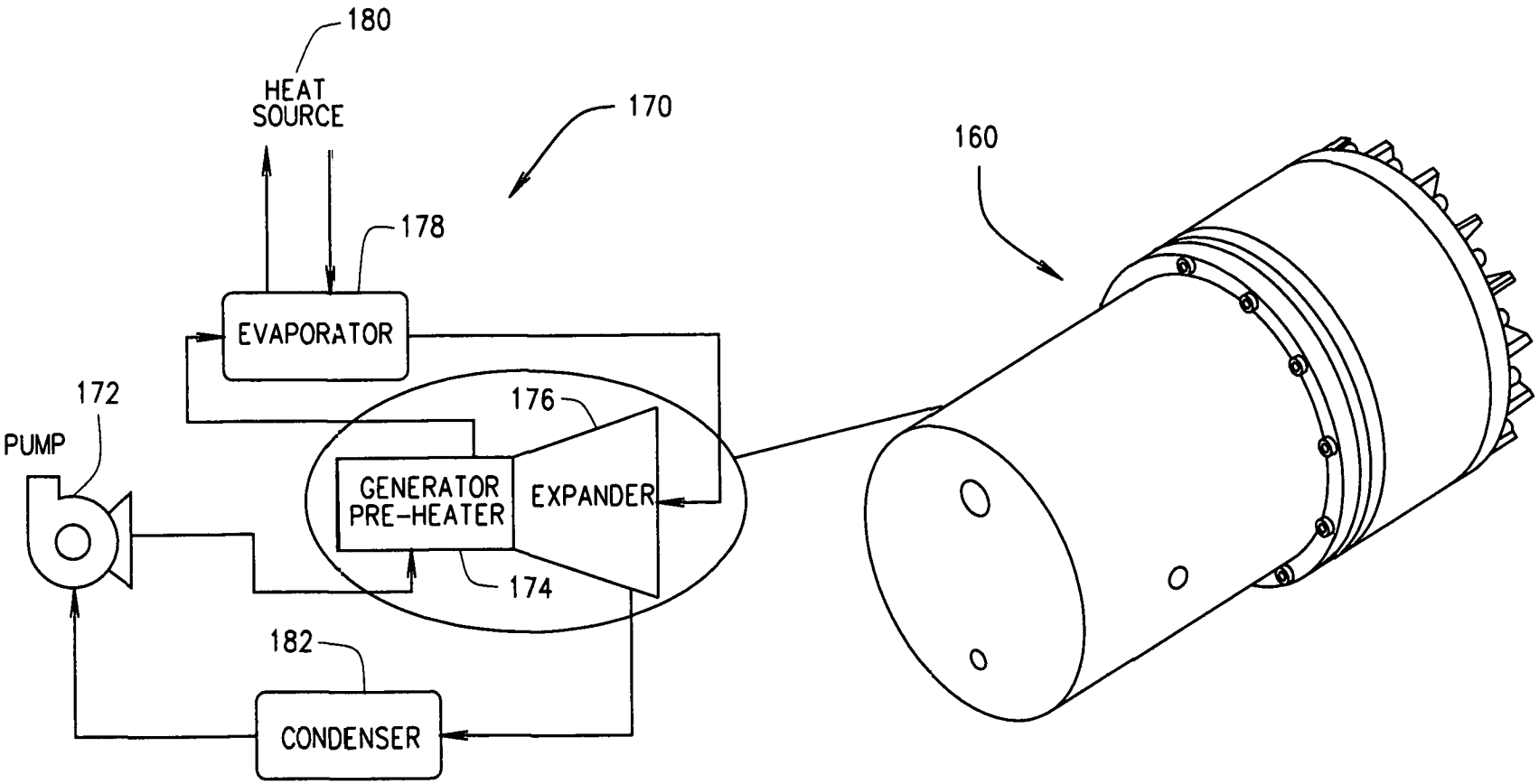
FIG. 12 is a perspective view of the compact Organic Rankine Cycle device shown in FIG. 11 with internal components shown in block diagram form.

FIG. 12 depicts a perspective view of the CORC device 150 shown with a number of internal components 170 of the device 150 shown in block diagram form. The internal components 170 include a pump 172, a generator pre-heater 174, an expander 176, an evaporator 178, a heat source 180, and a condenser.

Figure 13:
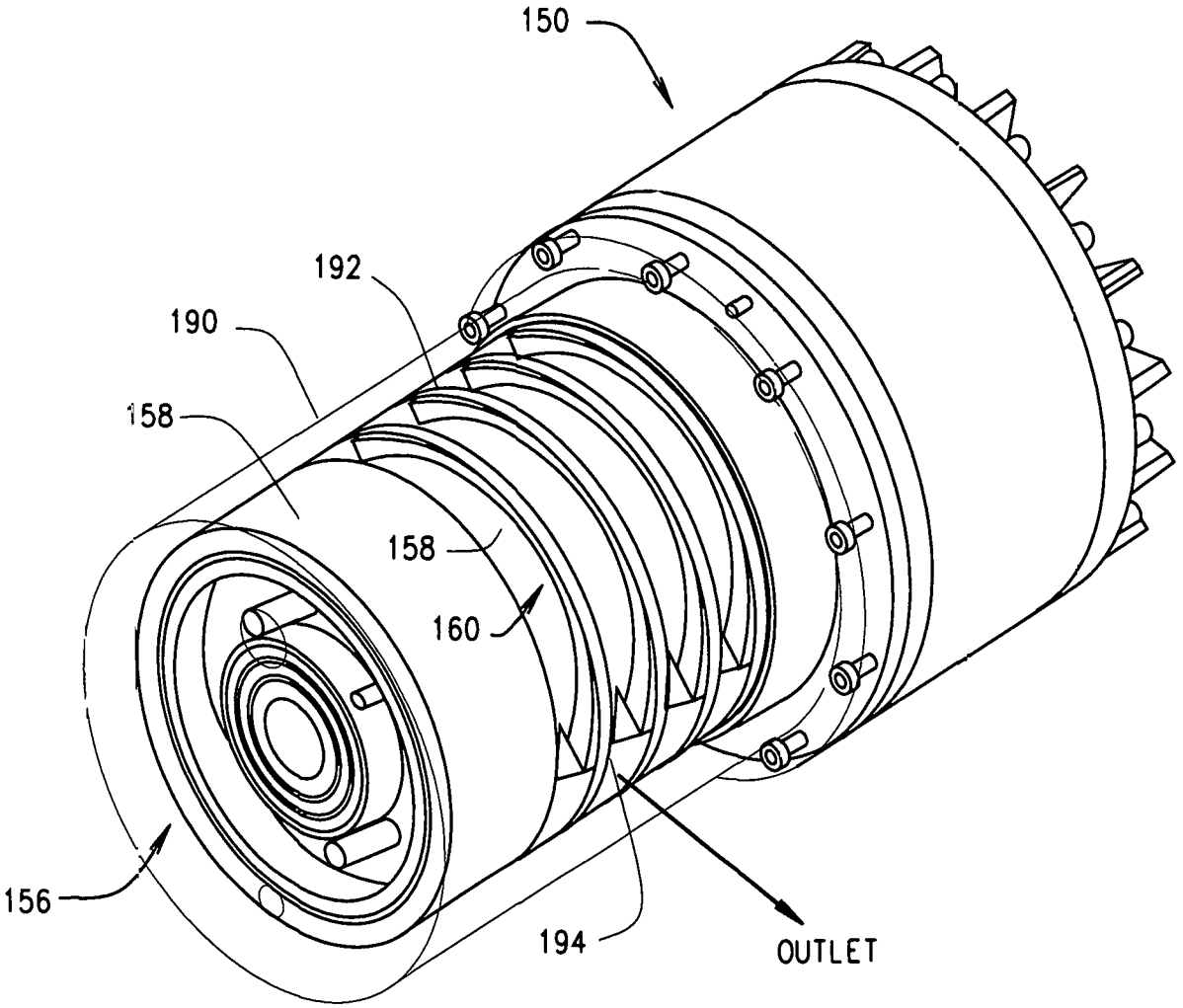
FIG. 13 is a perspective view of the compact Organic Rankine Cycle device shown in FIG. 11 with a cover shown in phantom to show an outlet portion.

With reference now to FIG. 13, a perspective view of the CORC device 150 is illustrated with a cover 190 being shown in phantom to show the passage 160 for refrigerant 192. The refrigerant 192 is capable of flowing around the passage 160 of the generator housing 158 to cool the housing 158 which in turn cools the generator 156. The passage 160 also has an outlet 194 that allows any heat generated by the generator 156 to be reclaimed to improve the overall efficiency of the device 150.

Figure 14:
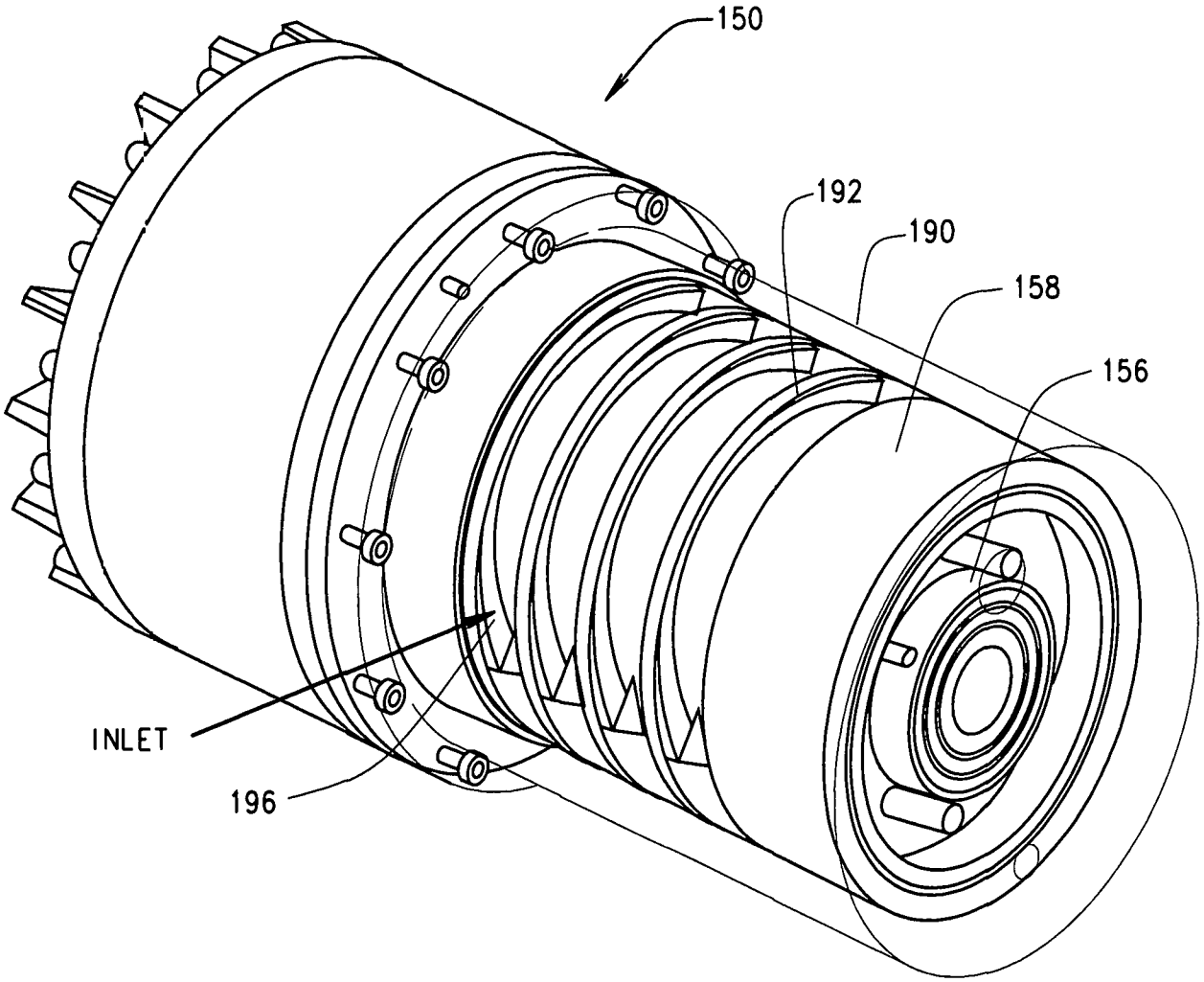
FIG. 14 is a perspective view of the compact Organic Rankine Cycle device shown in FIG. 11 with a cover shown in phantom to show an inlet portion.

FIG. 14 illustrates a perspective view of the CORC device 150 is illustrated with the cover 190 being shown in phantom to show the passage 160 for refrigerant 192. The refrigerant 192 enters into the passage 160 from an inlet 196. Although not shown, the refrigerant 192 is provided from a discharge of a pump within the device 150. The refrigerant 192 is used to cool the generator 156 and the housing 158. Heat generated by the generator 156 is reclaimed to improve the overall efficiency of the device 150.

In light of all the foregoing, it should thus be apparent to those skilled in the art that there has been shown and described a compact energy cycle construction of a unique design that integrates within a compact container rotating components that share a common shaft along which working fluid transits between rotary working fluid treatment devices to flow toroidally within the container as the construction operates as or in accordance with an energy cycle. However, it should also be apparent that, within the principles and scope of the disclosure, many changes are possible and contemplated, including in the details, materials, and arrangements of parts which have been described and illustrated to explain the nature of the disclosure. Thus, while the foregoing description and discussion addresses certain preferred embodiments or elements, it should further be understood that concepts, as based upon the foregoing description and discussion, may be readily incorporated into or employed in other embodiments and constructions without departing from the scope of the disclosure. Accordingly, the following claims are intended to protect the disclosure broadly as well as in the specific form shown, and all changes, modifications, variations, and other uses and applications which do not depart from the spirit and scope of the disclosure are deemed to be covered by the disclosure, which is limited only by the claims which follow.

What is claimed is:

1. A compact energy cycle construction that utilizes a working fluid in its operation, comprising:

a compact housing of a generally cylindrical form;

a scroll expander;

a central shaft which is driven by the expander;

a generator having a rotor and a stator with the central shaft being mounted to the rotor for rotating the rotor relative to the stator;

a pump mounted to the central shaft, wherein the generator is positioned between the scroll expander and the pump along the central shaft, wherein a refrigerant is discharged from the pump into a passage around an outer surface of the generator to cool the generator and to reclaim any heat produced by the generator to improve the efficiency of the compact energy cycle construction;

an evaporator positioned between the expander and the generator and surrounding the central shaft; and the scroll expander, the central shaft, the generator, the pump, and the evaporator being housed within the compact housing to form an integrated system operable in accordance with an energy cycle.

2. The compact energy cycle construction of claim 1 wherein the scroll expander is an orbiting scroll type expander.

3. The compact energy cycle construction of claim 1 wherein the scroll expander is a spinning type expander.

4. The compact energy cycle construction of claim 1 wherein the pump is a positive displacement type pump.

5. The compact energy cycle construction of claim 1 wherein the evaporator is constructed of extruded aluminum.

6. The compact energy cycle construction of claim 1 wherein the evaporator comprises an extruded aluminum tube having an end cap.

7. The compact energy cycle construction of claim 1 further comprising a generator housing that covers the generator and that defines the passage around the outer surface of the generator.

8. A compact energy cycle construction that utilizes a working fluid in its operation, comprising:

a compact housing of a generally cylindrical form;

a scroll expander having an inlet;

a central shaft which is driven by the expander;

a generator having a rotor and a stator with the central shaft being mounted to the rotor for rotating the rotor relative to the stator;

a pump mounted to the central shaft;

an evaporator positioned between the expander and the generator and surrounding the central shaft, the evaporator having a discharge;

an external tube for transporting a working fluid from the discharge of the evaporator, outside of the compact housing, and to the inlet of the expander; and the scroll expander, the central shaft, the generator, the pump, and the evaporator being housed within the compact housing to form an integrated system operable in accordance with an energy cycle.

9. The compact energy cycle construction of claim 8 wherein the scroll expander is an orbiting scroll type expander.

10. The compact energy cycle construction of claim 8 wherein the scroll expander is a spinning type expander.

11. The compact energy cycle construction of claim 8 wherein the pump is a positive displacement type pump.

12. The compact energy cycle construction of claim 8 wherein the evaporator is constructed of extruded aluminum.

13. The compact energy cycle construction of claim 8 wherein the evaporator comprises an extruded aluminum tube having an end cap.

14. The compact energy cycle construction of claim 13 wherein the end cap is brazed on the extruded aluminum tube.

15. The compact energy cycle construction of claim 8 further comprising a generator housing having a passage and the pump further comprises a discharge connected to the passage, and a refrigerant that is discharged from the pump for cooling the generator and for reclaiming any heat produced by the generator to improve the efficiency of the compact energy cycle construction.

16. A compact energy cycle construction that utilizes a working fluid in its operation, comprising:

a compact housing of a generally cylindrical form;

a scroll expander;

a central shaft which is driven by the expander;

a generator having a rotor and a stator with the central shaft being mounted to the rotor for rotating the rotor relative to the stator;

a pump mounted to the central shaft;

an evaporator positioned between the expander and the generator and surrounding the central shaft;

an external condenser surrounding a portion of the housing; and the scroll expander, the central shaft, the generator, the pump, and the evaporator being housed within the compact housing to form an integrated system operable in accordance with an energy cycle;

wherein the external condenser comprises a shroud and a fan connected to the housing.

17. The compact energy cycle construction of claim 16 wherein a discharge from the pump is routed in such a way to cool the generator and reclaim the heat from the generator to improve the overall efficiency of the construction.

18. A compact energy cycle construction that utilizes a working fluid in its operation, comprising:

a compact housing of a generally cylindrical form;

a scroll expander;

a central shaft which is driven by the expander;

a generator having a rotor and a stator with the central shaft being mounted to the rotor for rotating the rotor relative to the stator;

a generator housing for covering the generator, the generator housing having a passage positioned around the generator, wherein a refrigerant flows through the passage to cool the generator;

a pump mounted to the central shaft, wherein the pump further comprises a discharge connected to the passage, and the refrigerant is discharged from the pump for cooling the generator and for reclaiming any heat produced by the generator to improve the efficiency of the compact energy cycle construction;

an evaporator positioned between the expander and the generator and surrounding the central shaft; and the scroll expander, the central shaft, the generator, the generator housing, the pump, and the evaporator being housed within the compact housing to form an integrated system operable in accordance with an energy cycle.

* * * * *